US005577733A

United States Patent [19]

Downing

[11] Patent Number: 5,577,733

[45] Date of Patent: Nov. 26, 1996

[54] TARGETING SYSTEM

[76] Inventor: Dennis L. Downing, 403 David, Friendswood, Tex. 77546

[21] Appl. No.: 319,279

[22] Filed: Oct. 6, 1994

Related U.S. Application Data

[63] Continuation-in-part of Ser. No. 225,257, Apr. 8, 1994.

[51] Int. Cl.[6] ..... F41J 5/02

[52] U.S. Cl. ..... 273/348; 273/317; 273/371; 273/382; 434/16; 250/222.2

[58] Field of Search ..... 273/371, 317, 273/348, 358, 366, 381, 382, 404, 181 H; 434/20, 21, 22, 23, 16; 250/222.1, 222.2

[56] References Cited

U.S. PATENT DOCUMENTS

| | | | |
|---|---|---|---|
| 3,047,723 | 7/1962 | Knapp | 273/371 |
| 3,401,937 | 9/1968 | Rockwood et al. | 250/222.2 |
| 3,475,029 | 10/1969 | Hyman | 250/222 X |
| 3,487,226 | 12/1969 | Yetter et al. | 250/222 |
| 3,624,401 | 11/1971 | Stoller | 273/102.2 BX |
| 3,727,069 | 4/1973 | Crittenden, Jr. | 273/371 |
| 3,802,098 | 4/1974 | Sampson et al. | 273/102.2 |
| 3,807,858 | 4/1974 | Finch | 356/1 |
| 3,824,463 | 7/1974 | Oehler | 324/179 |
| 3,849,910 | 11/1974 | Greenly | 273/358 |
| 3,874,670 | 4/1975 | Weihl | 273/105.6 |
| 4,128,761 | 12/1978 | Oehler | 250/222 R |
| 4,142,723 | 3/1979 | Rief | 273/102.2 |
| 4,150,825 | 4/1979 | Wilson | 273/181 H |
| 4,155,096 | 5/1979 | Thomas et al. | 358/125 |
| 4,204,683 | 5/1980 | Filippini et al. | 273/371 |
| 4,239,962 | 12/1980 | Oehler | 250/222 R |
| 4,243,879 | 1/1981 | Carroll et al. | 250/221 |
| 4,267,443 | 5/1981 | Carroll et al. | 250/221 |
| 4,497,576 | 2/1985 | Caussignac et al. | 250/222.2 |
| 4,531,052 | 7/1985 | Moore | 235/404 |

(List continued on next page.)

FOREIGN PATENT DOCUMENTS

| | | | |
|---|---|---|---|
| 0182397 | 10/1985 | European Pat. Off. . | |
| 2914329 | 11/1979 | Germany | 250/222.2 |
| 4005940 | 8/1991 | Germany | 273/371 |
| 25697 | 1/1990 | Japan | 434/20 |
| 25696 | 1/1990 | Japan | 434/20 |
| 44198 | 2/1990 | Japan | 273/371 |
| PCT/US93/07227 | 3/1992 | WIPO . | |

OTHER PUBLICATIONS

Official Gazette—Patents; Aug. 1, 1995; entry for U.S. patent 5,437,463 issued to Fromm; p. 149.

"Jane's Military Training And Simulation Systems", 7th ed., 1994–95.

"BARCODATA 5100 LC and 8100 LC," Barco, Inc.

"AMPRO Large Screen Projectors," AmPro Corporation.

(List continued on next page.)

*Primary Examiner*—Jessica J. Harrison
*Assistant Examiner*—James Schaaf
*Attorney, Agent, or Firm*—Guy McClung

[57] ABSTRACT

The present invention, in one embodiment, is a targeting system for a shooter of a gun, the system having a target image created by a projector and projected on a target screen or, in one embodiment, a pre-printed target. A light panel is disposed between the target and the gun so that a bullet from the gun passes through the light panel which sends signals indicative of the bullet's location and velocity to a computer in which the signals are stored and, in one aspect, analyzed and compared with additional data such as previous bullet locations, velocity, and ballistic parameters for such a bullet. In one embodiment a light panel has one or more light emitters which emit a fan-shaped beam of light in a plane and spaced apart from the emitter(s) one or more light detectors. In one aspect such a panel has on-board electronics for calculating: object (e.g. bullet) velocity; and/or object (e.g. bullet) size. Methods are described for using such systems and such panels.

40 Claims, 21 Drawing Sheets

U.S. PATENT DOCUMENTS

| | | | |
|---|---|---|---|
| 4,384,201 | 5/1983 | Carroll et al. | 250/221 |
| 4,437,672 | 3/1984 | Armantrout | 273/181 H |
| 4,467,193 | 8/1984 | Carroll | 250/216 |
| 4,563,005 | 1/1986 | Hand et al. | 273/371 |
| 4,645,920 | 2/1987 | Carroll et al. | 250/221 |
| 4,672,364 | 6/1987 | Lucas | 340/712 |
| 4,684,801 | 8/1987 | Carroll et al. | 250/221 |
| 4,698,489 | 10/1987 | Hickin et al. | 235/407 |
| 4,713,534 | 12/1987 | Masters et al. | 250/214 B |
| 4,761,637 | 8/1988 | Lucas et al. | 340/365 |
| 4,763,903 | 8/1988 | Goodwin et al. | 273/371 |
| 4,789,932 | 12/1988 | Cutler | 273/348 |
| 4,799,044 | 1/1989 | Masters et al. | 341/5 |
| 4,818,859 | 4/1989 | Hough | 250/221 |
| 4,845,690 | 7/1989 | Oehler | 368/113 |
| 4,890,500 | 1/1990 | Giles | 250/222.2 |
| 4,919,528 | 4/1990 | Pitalo et al. | 350/620 |
| 4,943,806 | 6/1990 | Masters et al. | 341/31 |
| 4,949,972 | 8/1990 | Goodwin et al. | 273/371 |
| 4,965,439 | 10/1990 | Moore | 235/404 |
| 4,970,589 | 11/1990 | Hanson et al. | 358/108 |
| 4,988,983 | 1/1991 | Wehrer | 340/712 |
| 5,015,840 | 5/1991 | Blau | 250/221 |
| 5,026,158 | 6/1991 | Golubic | 356/252 |
| 5,031,349 | 7/1991 | Vogel | 42/103 |
| 5,031,920 | 7/1991 | Poirier | 273/371 |
| 5,111,476 | 5/1992 | Hollenbeck et al. | 372/107 |
| 5,121,188 | 6/1992 | Partridge et al. | 357/74 |
| 5,198,661 | 3/1993 | Anderson et al. | 250/221 |
| 5,230,505 | 7/1993 | Psquet et al. | 250/206.2 |
| 5,310,192 | 5/1994 | Miyake | 273/310 |
| 5,316,479 | 5/1994 | Wong et al. | 434/11 |
| 5,328,190 | 7/1994 | Dart et al. | 273/371 |
| 5,375,072 | 12/1994 | Cohen | 364/561 |
| 5,382,026 | 1/1995 | Harvard et al. | 273/310 |
| 5,437,463 | 1/1995 | Fromm | 434/20 |

OTHER PUBLICATIONS

"Packaging by passive cooling reduces manufacturing costs of laser diode arrays," Laser Focus World, 1994.
". . . So Get Mobilized," Texas Microsystems, Inc., 1994.
"Laser Diode OEM Systems and Components," Power Technology Incorporated, Feb. 1993.
"General Catalog KA–SW–07 Sensors," Keyence Co.
"General Catalog KA–ME–04 Measuring Instruments," Keyence Co.
"Optoelectronics Infrared Products," Honeywell Catalog E26, 1993.
"Optoelectronics Components Catalog," UDT Sensors, Inc.
"Going For The Glow," National Geographic World, Jun. 1994, pp. 3–6.
"Applied Laser Sysems," Applied Laser Systems.
"Welcome To The World Of Lasiris," Lasiris, Inc.
"Diode Laser Instruments," Micro Laser Systems.
"Laser Diode Collimating And Objective Lenses," Optima Precision, Inc.
"Positioning Controls & Motor Drives," Design Components, Inc.
"Optoelectronics Data Book 1993, 1994," Siemens, Inc.
"Barcographics 808," Barco, Inc.
"Data Projections 1994 Catalog," Data Projections, Inc.
"Optoelectronics Device Data DL 118/D REV 4," Motorola, Inc.
"Short Form Vol. 41, Total Solution For PC–Based Industrial and Lab Automation," American Advantech Corporation.
"Pen Ray Lamps," UVP, Inc.
"LIMO Lissotschenko Mikrooptik," LIMO Gmbtt.
"Electro–Optical Product Guide," Aerotech, Inc.
"STI Product Databook," Scientific Technologies Incorporated.
Nonte, "Firearms Encyclopedia," pp. 7–9, 16–17, 20, 21, 116, 117, 138, 139, 164, 163, 230, 231, 246, 247, 270, 271; 1977.
Fadala, "The Rifleman's Bible," pp. 44–55, 68–73; 1987.
O'Conner, "Complete Book of Rifles & Shotguns," pp. 242–267; 1976.
Hornaday, "hornday Handbook of Cartridge Reloading," pp. 2–9, 132–133, 386, 387, 468–471; 1992.
Speer, "Reloading Manual No. 11," pp. 3, 80–91, 466–471, 482–487, 492–509, 542–547, 608–621; 1987.
Spieth, "Shooting Range Equipment," 6 pages prior to 1993.
Laurin Publishing Co., "The Photonics Design & Applications Handbook," Book 3, pp. H–176, H–177; 1994.
Technohunt, "The Interactive Archery Video System For The Future,"; 1993.
Dart Target Systems, "We Mean Businessm,"; 1993.
Snyder, "Cylindrical Micro–optics," Spie Proceedings; 1992.
NSG America Inc, "Selfoc Product Guide," 1993.
Welch Allyn, "Miniature Reflectors," 1993.
Power Technology Incorporated, "Laser Diode OEM Systems," 1993.
In Focus Systems, Inc., "Great Ideas Brought To Light," 1994.
PACT, "Professional Chronograph," 1993.
American Rifleman, "Rollabull Target Machine," pp. 55–56; 1992.
Dingle, "Federal Firearms Training Sets The Standard," pp. 10–13, Guns & Weapons, 1994.
Aagaard, "PACT: The Answer Machines," pp. 38, 39, 83, 85, American Rifleman 1993.
Petty, "What's The Timer," pp. 36–37, 76, American Rifleman 1993.
"Sunx Sensors," 1993.
Banner Eng. Corp., "Handbook of Photoelectric Sensing," 1993.
Motorola, "Optoelectronics Device Data," 1993.
Safford, et al, "Fiberoptics And Laser Handbook 2nd Edition," 1988.
"Ballistic Explorer The Friendly Ballistics Program," Jan. 1993.
Davis, "Oehler's Model 35 P Chronograph," 1993.
Oehler Research, "Oehler Ballistic Chronographs," 1994.
Schuh, "Interactive Video For Hunters," Sports Afield, May 1994.

$$X = a + \frac{\sqrt{2a^2} \cdot \mathrm{SIN}(45° + \emptyset_e) \cdot \mathrm{SIN}\ \emptyset_E}{\mathrm{SIN}(90° - \emptyset_E - \emptyset_e)}$$

$$Y = a + \frac{\sqrt{2a^2} \cdot \mathrm{SIN}(45° + \emptyset_E) \cdot \mathrm{SIN}\ \emptyset_e}{\mathrm{SIN}(90° - \emptyset_E - \emptyset_e)}$$

TARGETING SYSTEM

RELATED APPLICATIONS

This is a continutation-in-part of U.S. Ser. No. 08/225,257 filed on Apr. 8, 1994 entitled "Target System".

BACKGROUND OF THE INVENTION

1. Field of the Invention

This invention is related to target systems; and in one aspect to computer-controlled systems for target projection, shot monitoring, automatic sight adjustment, sight error calculation, calculation of ballistic parameters and display thereof, and bullet recovery in an environmentally sensitive manner.

2. Description of Related Art

The prior art contains a wide variety of target systems and ballistic instruments. These include the subject matter of the references discussed below. These discussions do not present the subject matter of these patents in their entirety. Only a detailed review of the entire text and all drawings of these patents will reveal their complete disclosures.

U.S. Pat. No. 5,031,920 discloses a gun shooting range with a target chamber position at the target end where a still target is projected. A camera focused on a target on the chamber projects an image of the target to the shooting end where it is displayed on a screen of a video micrometer. The video micrometer has cross hair reticles that a shooter moves to place over a screen image of a target with a bullet hole and that measure a shot pattern generated on a roll paper target. The video micrometer has a tape recorder for recording the transmitted image, a printer for printing a hard copy of the pattern, a keyboard for data input, and is connectable to a computer for input and storage of the shot pattern data. A target feed mechanism is electrically controlled.

U.S. Pat. No. 5,031,349 discloses a method for aligning adjustable sights on a firearm with the point of bullet impact at a given range in which the sights are aligned during firing range testing including the use of a laser beam from a portable laser unit mounted on the firearm sights which beam indicates the alignment of the sights vis-a-vis the target. A spotting scope is used to detect a bullet's point of impact on a target. Gun sights are manually adjusted.

U.S. Pat. No. 5,026,158 discloses an apparatus and method for determining and recording a calculated impact point of one or more projectiles discharged from a firearm including a sighting mechanism with a field of view display unit, sensor elements, a recording unit, and a trajectory calculating microprocessor unit, the microprocessor unit for storing parameter data and for responding to sensor and/or manual data input signals and modifying the image presented by the field of view display unit. The trajectory calculating microprocessor unit, in response to the sensor data and parameter data, determines the trajectory of a projectile. The calculated impact point of the projectile is used to superimpose an indicia, namely an impact point-reticle on the image of the field of view of the display unit relative to the zero-range reticle or standard cross-hair setting. The system has a video camera with freeze-frame capability mounted on a rifle and a viewfinder displays scope cross-hairs and a second impact-point reticle which shows where the bullet would have impacted the target, based on the results of an on-board trajectory calculating microprocessor unit together with ballistic information on the trajectory, environmental factors (wind, barometric pressure, etc.), range of target, etc. Adjustment of the scope zero-range reticle is done manually on a firing range using live ammunition. Then the invention does not use ammunition and simulates a hunting experience by predicting and displaying the point of impact of an imaginary bullet on a target image frozen into the viewfinder.

U.S. Pat. No. 4,949,972 discloses an automatic target shooting system for determining projectile location relative to a target, calculating a score based upon the location and displaying a replica of the target with an indication of the location of the projectile relative to the target and the score. A target support structure defines a target area with criss-crossing X-Y-type coordinate light beams extending thereacross between light emitter devices and light receiving devices which generate output signals indicative of the location of a projectile during passage through the target area. The light beams are not modified by lenses or any light modifying device. The output signals are utilized by a computer device to identify the location of the projectile relative to the target and score the shot in accordance with the location. A replica of the target is displayed on a CRT screen with an indication of the location of the shot thereon and the score for the shot.

U.S. Pat. No. 4,919,528 discloses a boresight alignment verification device for testing sophisticated sighting and weapon systems used on various types of military aircraft and vehicles. The alignment device measures boresight error between a reference line of sight, a vehicle sighting system and a weapon system. The boresight alignment verification device is used to sight weapons on aircraft and vehicles while stationary. A collimated beam of light is generated by the optical verification device and transmitted through a telescoping periscope system of mirrors and prisms to a gun bore. An optical reference fixture is placed in the gun bore to reflect the light (e.g. back through the telescoping periscope to sensor optics and a matrix camera contained in the main housing of the boresight alignment verification device. A computer in the unit stores the alignment data for later use. A matrix camera senses the different locations of the reference beam vs. the retroreflected beam.

U.S. Pat. No. 4,845,690 discloses a chronograph system with three shot-sensing screens which provide start and stop signals to interval-determining timers. The first screen provides a start signal to both timers and the subsequent screens provide stop signals to the first and second timers, respectively. The time intervals measured by these timers are divided into the distances between the screens to separately calculate two velocities based on two different distances. The calculated velocities are compared to evaluate the performance of the instrumentation so that measurement errors resulting from the instrumentation itself can be eliminated from analysis of the test shots.

U.S. Pat. No. 4,698,489 discloses a boresight correction system that determines the existing error between an aircraft gunsight and its gun systems while prescribed aircraft maneuvers are performed and which automatically corrects the gunsight system to compensate for this error. The system includes a sensor for detecting bullet positions, hardware that determines the bullet positions relative to the gun boresight, a digital processor to determine the above mentioned error, and to correct the gunsight system according to this error, and a non-volatile memory in the digital processor to store a corrected boresight position. A cockpit television camera records the path of projectiles fired from an aircraft while in flight. A video processor scans a sequence of frames received from the cockpit television and records the apparent location of the bullet path or position within the frame.

Software in the digital processor calculates a relative error between the measured bullet positions and predicted (or desired) bullet positions. The gun boresight symbol is then adjusted accordingly to correct for sighting error.

U.S. Pat. No. 4,239,962 discloses a ballistic velocity measuring device with two photodetectors spaced apart by an accurately known distance along a projectile path exposed to ambient light from the sky. The system has a sunshield and light diffuser structure for each (or both) of the photodetectors to eliminate light reflection from the projectile which can cancel the "shadow" of the projectile and prevent the photodetector from responding to passage of the projectile; and to increase the level of light to the photodetectors by diffusing direct sunlight.

U.S. Pat. No. 4,204,683 discloses a device and method for detection of the shots on a target having a closed video circuit with a camera positioned adjacent the target to receive light influenced by a projectile about to hit the target. A monitor of the video circuit is positioned adjacent to a shooter and provides indication of the shooter's shot on the monitor. The camera captures the reflection of a projectile as it passes through a plane of light immediately in front of the target. The video image is then projected onto a monitor which scans the image to determine coordinates of the projectile's reflection.

U.S. Pat. No. 4,155,096 discloses a system for boresighting the laser of a laser designator system to the null point of an automatic television tracker by selectively causing the laser beam to be retroreflected to the video sensor of the system which interfaces with a television tracker. The tracker locks onto the retroreflected laser spot, with the tracker error signals, in a feedback control loop, being used to control the video sensor raster bias to center the sensor sweeps about the laser spot, thereby nulling the tracker error signals and achieving boresight with the laser automatically. This includes a method for boresighting a laser beam to be directed against a distant target. Laser designators are used in conjunction with laser guided weapon delivery systems to retroreflect a portion of laser energy back to the unit's television point tracker and imaging optics. A video sensor and error processing electronics adjust the laser's alignment until it is on-target. Error signal processing electronics automatically adjust the laser's alignment.

U.S. Pat. No. 4,128,761 discloses a system in which light perturbations sequentially produced by a projectile at spaced points are detected by photodetectors connected to a logarithmic diode circuit which is AC coupled to an amplifier time-shared by the detectors. Successive pulses from the amplifier are interpreted by logic circuits to start and stop an interval counter.

U.S. Pat. No. 3,824,463 discloses a shot cluster velocity measuring apparatus in which the coils through which the shot is to sequentially pass are mounted in axially spaced relation and are electrically connected as frequency determining elements in a high frequency oscillator, the output of which is frequency modulated as the shot cluster passes the coils. An FM discriminator generates an amplitude varying signal representative of the frequency modulation. A differentiating and filtering circuit shapes the discriminator output which is then amplified. The gain of a variable gain amplifier is automatically adjusted to equalize signal amplitude, and a Schmitt trigger produces rectangular pulses. If the pulses out of the trigger are of sufficient duration they are used to produce "start" and "stop" signals, indicating the passage of the center of mass of the projectile or projectile cluster through the first and second coils, respectively. These signals are then used to control an interval timer which displays the count as a measure of velocity.

U.S. Pat. No. 3,807,858 discloses a method and apparatus for determining the position at which a projectile passes through an area in space. Two light beams are projected to scan the whole of the area in space, and detector means are provided for detecting the reflections of said beams off a projectile passing through said area. Means are provided for determining the angular relationship of the reflected beams relative to established reference lines at spaced reference points to accurately determine by triangulation the position at which the projectile passes such area in space.

U.S. Pat. No. 3,727,069 discloses a target system for measuring the location and diameter of a projectile in a frame of reference, including vertical and horizontal banks of light sources for projecting collimated beams of light across the target area, and corresponding vertical and horizontal banks of light receptors for indicating the location and diameter of a projectile passing through the target frame. A plurality of light receptors receive impinging light from each light source, each light receptor receiving a predetermined portion of a corresponding collimated light beam. When a light beam is interrupted by a projectile, the light receptors indicate the location and diameter of a projectile in increments less than the width of the collimated beam. Output signals from the light receptors are converted to numerically coded signals by coupling the output signals from the light receptors to a plurality of amplifiers, less in number than the number of light receptors, according to a predetermined coding pattern. A system of lenses, slits and baffles is used to produce a matrix pattern of collimated light beams and focus them on corresponding light sensors to form a X-Y coordinate grid. Incandescent lamps or lasers are used. Two light panels are used in a chronograph arrangement. The light panel outputs signals from photocells coupled to amplifiers. The signals are processed by a digital computer or other device having a similar capability.

U.S. Pat. No. 3,624,401 discloses a scoring system for nonmaterial target by directing ultraviolet light across the face or front of the target in such manner that a projectile striking the target must pass through the ultraviolet light. Photoelectric sensors are arranged to detect ultraviolet light reflected from projectiles passing through the light and striking the target. The light passes through coded masks associated with each sensor. The coding of the masks is such that the sensors respond discretely to indicate the position of the projectile with respect to the target and thus a "hit" or a "miss." Ultraviolet light is projected from two sides into an area immediately in front of a target. Photoelectric sensors are arranged to detect UV light reflected from projectiles passing through the light beams and striking the target. Each photosensor has masks or slits so that it can sense relative angular location of a passing projectile. Using triangulation, the detector system outputs pulses of electricity which are counted. Different numbers of pulses correspond to different target hit locations. The pulse counters register the hits on the target and are connected to a decoding circuit to indicate the value of a particular hit. The decoding circuit forms an input to a register or recorder arranged to add the values of several hits and store the sum to keep the scores of several marksmanship trainees.

U.S. Pat. No. 3,487,226 discloses a method and electro-optical apparatus for deriving time signals from the passage of a bullet through a series of intersecting optical planes, the time signals being utilized to provide information on bullet velocity and on the azimuth and/or altitude of the bullet trajectory. Four panels or "screens" of collimated light beams are arranged so that all four planes of light are broken by the passage of a projectile through the device. Two panels are vertical and two are transverse. Three time interval measuring devices are used to clock the projectiles passing between successive light planes. This information is recorded and used to calculate the location (X-Y coordinate) of the projectile. The light sources are incandescent lamps or other electromagnetic radiation sources such as lasers, infrared, ultraviolet and microwave sources. Multiple light planes are used in a chronograph arrangement. A computer is used to automatically compute results. Chronograph outputs are connected to a small digital computer, which is programmed to automatically compute results such as the mean radius of a number of shots from center of impact, maximum deviation from center of impact, etc., as well as a correlation of each individual location with the velocity of the corresponding bullet. The system includes a printer for the computer.

U.S. Pat. No. 3,475,029 discloses a missile scoring detection system having spaced photoelectric sensing elements positioned to define a plurality of segmented indestructible target light matrices through which a missile may be propelled, a pumping system for establishing a fluid screen aligned with each target matrix, projectors for visually displaying indestructible target images on said fluid screen substantially aligned with said target matrices in line of intended missile fire, a signal circuit including transistors and AND gates responsive to said sensors in the passage of a missile through each segment of said matrices to develop output electrical signals, an electric display matrix responsive to said electrical signals for indicating the resultant accuracy of fire, and an instructor operated timer for unprogramed selection of the timing, location and duration of the projected images on said fluid screen. The display circuit means is connected to receive light interruption signals and to provide visual indication of the area of each of the light matrices penetrated by a missile and includes a counter for and connected to each AND circuit to visually indicate a hit in each cross ray area of said light matrices and to sum the hits in each area. Scoring is indicated by flashing a light or indexing a conventional resettable counter at a location on the operator's display panel corresponding to the relative location of the path of the projectile as sensed by the blocked light beams downrange. The display panel is a scaled replica of the light beam matrix located downrange. Projectors produce still target images and several projectors can be set up with a timer/shutter system to provide a sequence of different target images appearing at different times.

SUMMARY OF THE PRESENT INVENTION

The present invention, in one embodiment, teaches a targeting system for a shooter of a gun which produces a video target image created by a video projector and projected on a target screen or surface downrange from the shooter's position. In one aspect the target image is projected on a blank target paper or blank screen which, in certain embodiments, may include a roll or fan-folded sheet stack of such target screen or surface so that different targets are presented to the shooter and/or a new target is provided to a new shooter. In other embodiments a target roll or fan-folded sheet stack is used with targets printed thereon. In one aspect a drive mechanism moves the roll or fan-folded sheet stack so that an old screen or surface with bullet hole(s) therein is removed and a new surface is provided on which is a target image or on which a target image is projected. A light panel is disposed between the target and the gun so that a bullet from the gun passes through the light panel which sends signals indicative of the bullet's location to a computer in which the signals are stored and, in one aspect, analyzed and compared with additional data such as previous bullet locations and ballistic performance data and parameters for such a bullet.

In one embodiment of such a system the computer controls the target screen drive mechanism (either for a target roll or for a fan-folded sheet stack) and the video projector. In certain embodiments the computer selects a particular target image from a plurality of stored target images and this image is transmitted to the video projector for projection on the exposed target area or portion of the target screen. In certain embodiments using target rolls/sheets with target images printed thereon, a light(s) is used to illuminate the exposed target area. In certain other embodiments using target rolls/sheets with targets printed thereon, the target images use fluorescent material and/or are printed with fluorescent inks and an ultraviolet light source (black light) is used to illuminate the exposed target area.

In another embodiment a second light panel is disposed between the first light panel and the shooter so that signals are generated corresponding to the time of passage of the bullet through each light panel permitting the computer to calculate velocity of a bullet.

In one embodiment suitable light modifying devices (lenses, mirrors) are used to reduce or eliminate distortion of the projected target image. Bullet-proof and shock-isolated shields may be used with any of the parts of this system so that stray bullets do not damage the parts or affect accuracy; and a bullet trap may be employed behind the target to reduce or eliminate damage to the environment by the bullet(s).

In another embodiment the previously described systems include a computer monitor which displays a target image like the one on the target or the one being projected by the video projector on the target surface, screen or roll. After signals are received from the first light panel and processed by the computer, bullet hole location(s) are displayed on the target image on the computer monitor and/or tabular and/or graphical results of the shot and its position are also displayed on the monitor. In one aspect the computer transmits the image to an interconnected printer which provides a hard copy of any target image, data, calculations, or graph. In one aspect preprinted targets are used. In one embodiment such targets are preprinted on fluorescent material and/or with fluorescent ink or paint and a light projected onto the targets is ultraviolet light.

In one embodiment such systems include a sound system controlled by the computer which announces firing commands, firing sequences, bullet impact location(s), shot score, cumulative score, shot group size, and bullet data and parameters such as velocity or target impact location. In another embodiment the computer controls a computer-adjustable sighting device on the gun and changes sights in response to results of processed shot data or in response to input and commands from the shooter.

In another embodiment preprinted targets are used, or the video projector projects images with areas which are scored differently (e.g. a typical bullseye with different scores for the bullseye and rings radiating from it or images of different size in series across a target area). The computer calculates a score for each shot; a cumulative score for the shooter; and similar data for additional shooters. In another aspect moving targets are provided by appropriate transmission of suitable video images and/or by moving the target screen. Systems according to this invention sense a second bullet passing through a location identical to that of a first bullet.

In one embodiment a light panel is disclosed with an X-Y rectangular coordinate light grid with one or more light beams transmitted from one or more emitters to one or more detectors, and, in certain embodiments, with fiber optic cable(s) to transmit light from light emitter(s) to a location on a panel frame, and/or from a location on the frame via fiber optic cable(s) to photosensor(s). Lenses may be used on the frame in conjunction with the fiber optic cables. One such light panel has a plurality of close collimated light beams from emitters detected by light detectors in an X-Y rectangular coordinate grid or matrix. Another such light panel utilizes light sources which emit fan-shaped planes of light beams from one panel side towards a plurality of closely-spaced light detectors located on opposite panel sides, or towards the end of one or more fiber optic cables for transmitting the light to a location, device, or sensor remote from the panel. Radial light beam paths are created between emitters and detectors. Mathematical equations may be used to convert the angular (polar) coordinates of the beam paths to rectangular X-Y coordinates. In one aspect a light panel according to this invention has one or more light sources which emit a spread-out or fan-shaped light, in one aspect in a plane. One such light source is a laser including a laser diode used with line generating lenses. In one embodiment a light panel according to the present invention has at least two emitters which emit fan-shaped light beams toward an associated plurality of light detectors associated with each emitter. The panel frame may have two or more sides and the frame may be any desired shape.

In another embodiment a light panel has one fan-shaped emitter on one panel side and associated detectors on an opposite panel side (an "emitter/detector system") and is used to sense a moment-in-time at which an object passes through the central space in the panel frame. Moment-in-time signal can be used, in conjunction with a moment-in-time signal from another light panel spaced apart from the first panel at a known distance, to calculate the velocity of an object.

In one embodiment velocity of an object is determined with two different moment-in-time signals by two (or more) spaced-apart light panels, each with at least one fan-shaped emitter on one panel side and associated detectors on an opposite panel side. In one embodiment location coordinates and/or size/shape of an object passing through a light panel is determined with a panel with at least two fan-shaped emitters, one on one panel side and one on a panel top or bottom which is at an angle to the one panel side, with detectors associated with each emitter located on an opposite panel side. In certain embodiments two (or more) emitter/detector systems are not located in identically the same orientation on a panel frame, i.e., when viewed from a position perpendicular to the planes of the light beams, the light beams from two emitter/detector systems on different sides of a single panel frame cross in order for an object's location coordinates and size/shape to be determined.

In one embodiment a single location coordinate-sensing light panel with two emitter/detector systems creating parallel planes of light beams is used to determine an object's coordinates, velocity and shape/size. Some finite distance exists between the two parallel planes of light beams of the two emitter/detector systems and the object passing through the panel frame travels perpendicular to the two planes. The beams in one first plane are interrupted at a slightly different moment-in-time than the beams in a second plane, and a velocity is calculated using the two different moment-in-time signals and the distance between the two light planes. In one preferred embodiment the accuracy and resolution of the velocity calculation is enhanced by spacing apart the two planes of light beams a desired distance (e.g. twelve inches); to produce high accuracy and resolution for determining object location coordinates and object size/shape, in one preferred embodiment the two light beam planes are as close together as possible, or coinciding.

It is, therefore, an object of at least certain preferred embodiments of the present invention to provide:

New, useful, unique, efficient, safe, non-obvious devices and methods of their use for determining bullet location on a target, ballistic data and parameters of the bullet, and related methods;

Such devices with which stationary or moving video target images are displayed on a target area or moving target paper or screen;

Such devices in which targets, target image display, and/or target screen or roll/sheet movement by a drive mechanism are computer controlled;

Such devices in which light panel(s) send signal(s) to the computer which stores and processes them to produce data related to bullet velocity and target impact location;

Such devices with which the computer controls a monitor which can selectively display target images, images showing bullet impact location, and tables and/or graphs showing bullet data and ballistic parameters;

Such devices which store such information and display summaries, comparisons, totals, and/or tables for multiple shots by one shooter or for multiple shooters;

Such devices which calculate and total scores for scored targets for one or more shooters;

Such devices which provide a hard copy of any of the results which the computer generates;

Such devices which provide a user means to interact with the computer to direct and control system operation and input information necessary for the computer to perform its functions;

Such devices including a computer-adjustable sight on a gun and a computer-driven apparatus for adjusting sights;

Such devices including a bullet trap behind the target;

Such devices including a computer-controlled sound system for issuing commands, sequences, and results;

Such devices including bullet-proof shock-isolated shields, barriers, or protectors for some or all of the system components;

New, useful, unique, efficient, safe, and nonobvious computer-controlled sight adjustment systems;

New, useful, unique, efficient, safe, and nonobvious methods for using the above-listed items;

New, useful, unique, efficient and nonobvious methods employing a computer and appropriate computer software for accomplishing the various functions described according to this invention; and Such devices which compare the action of one or more bullets and their physical parameters with known tables of data for such bullets and, if desired, display the results.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention should be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
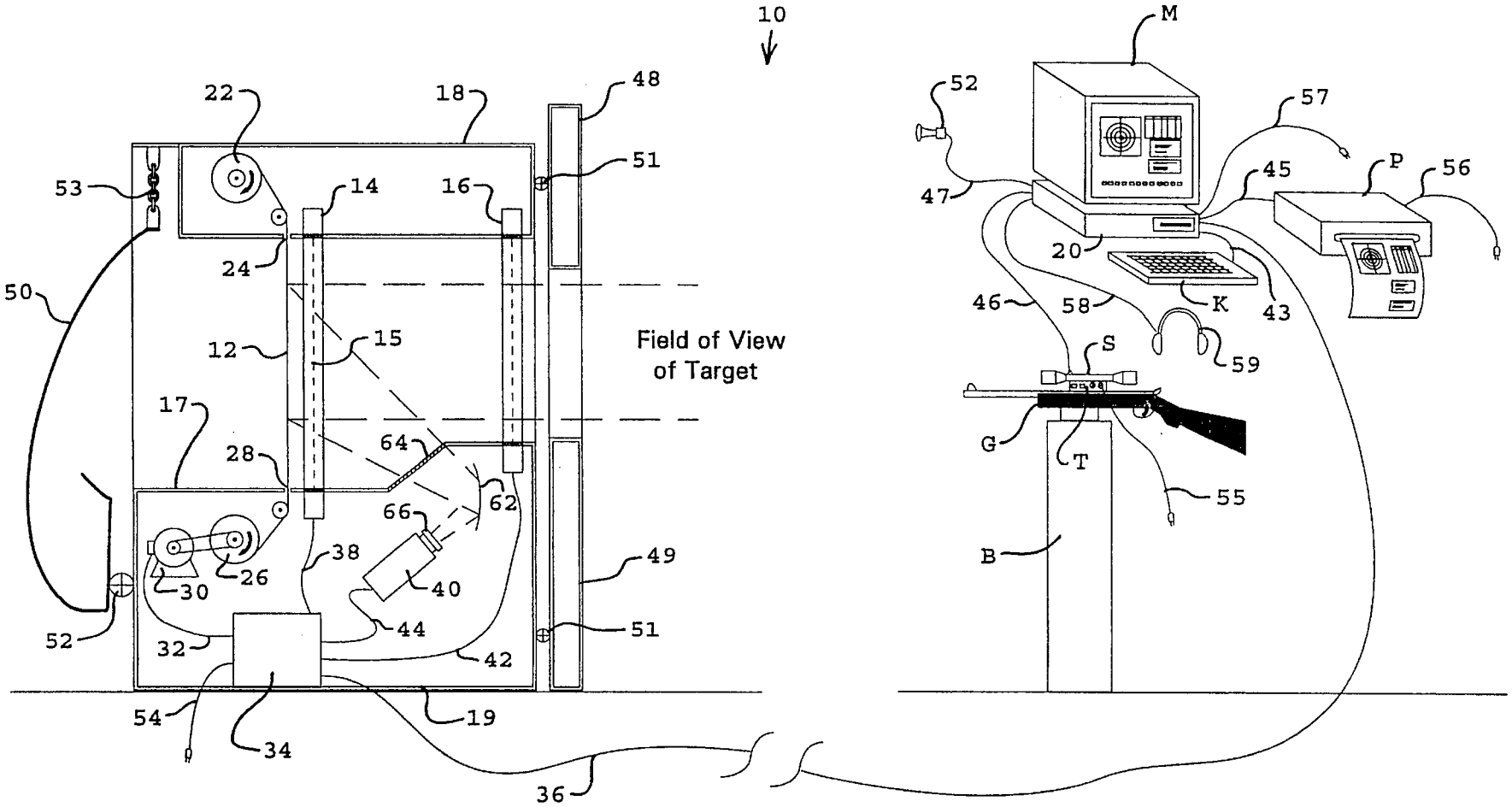
FIG. 1 is a schematic view of one target/ballistic system according to the present invention.
Figure 2:
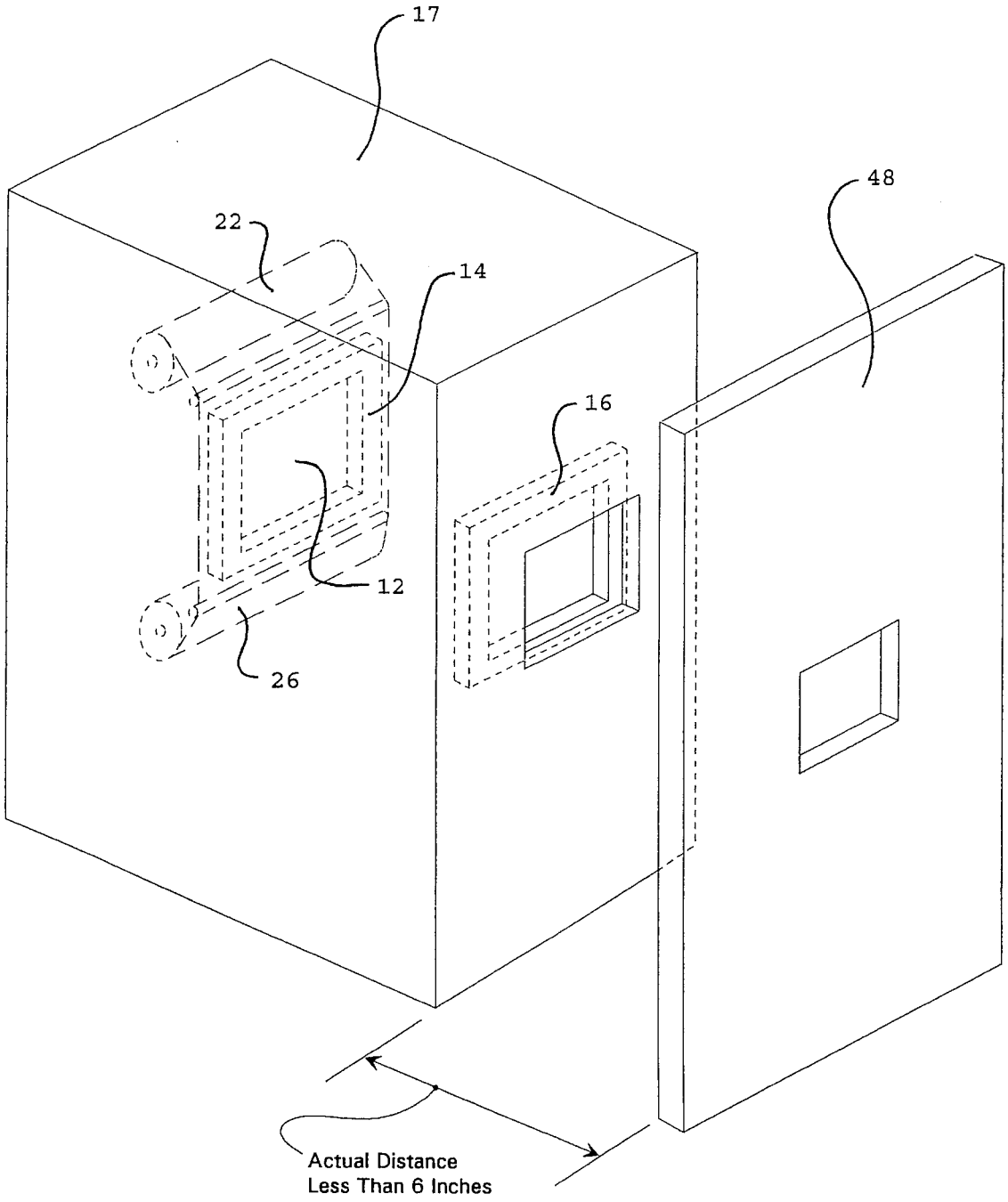
FIG. 2 is a partial perspective schematic view of the system of FIG. 1.

Referring now to FIGS. 1 and 2, a system 10 according to the present invention has a target screen 12 upon which impacts one or more bullets from a gun G on a bench B. Two light panels are positioned so that their light beams pass across an area through which bullets from the gun pass on their way to the target screen.

A first light panel 14 is mounted so that its light beams' paths (e.g. beam path 15) are relatively close to the surface of the target screen 12, preferably within about one inch of the screen or less and most preferably within one millimeter or less. Thus the location at which the bullets pass through the first light panel 14 corresponds to the point of impact on the target screen. Passage of a bullet through the first light panel generates a signal indicative of the bullet's location and moment in time of passage through the light panel. This signal is transmitted to a computer 20 which is discussed below and may be used to stop a timing clock whose timing operation is initiated by a signal from a second light panel.

Figure 13:
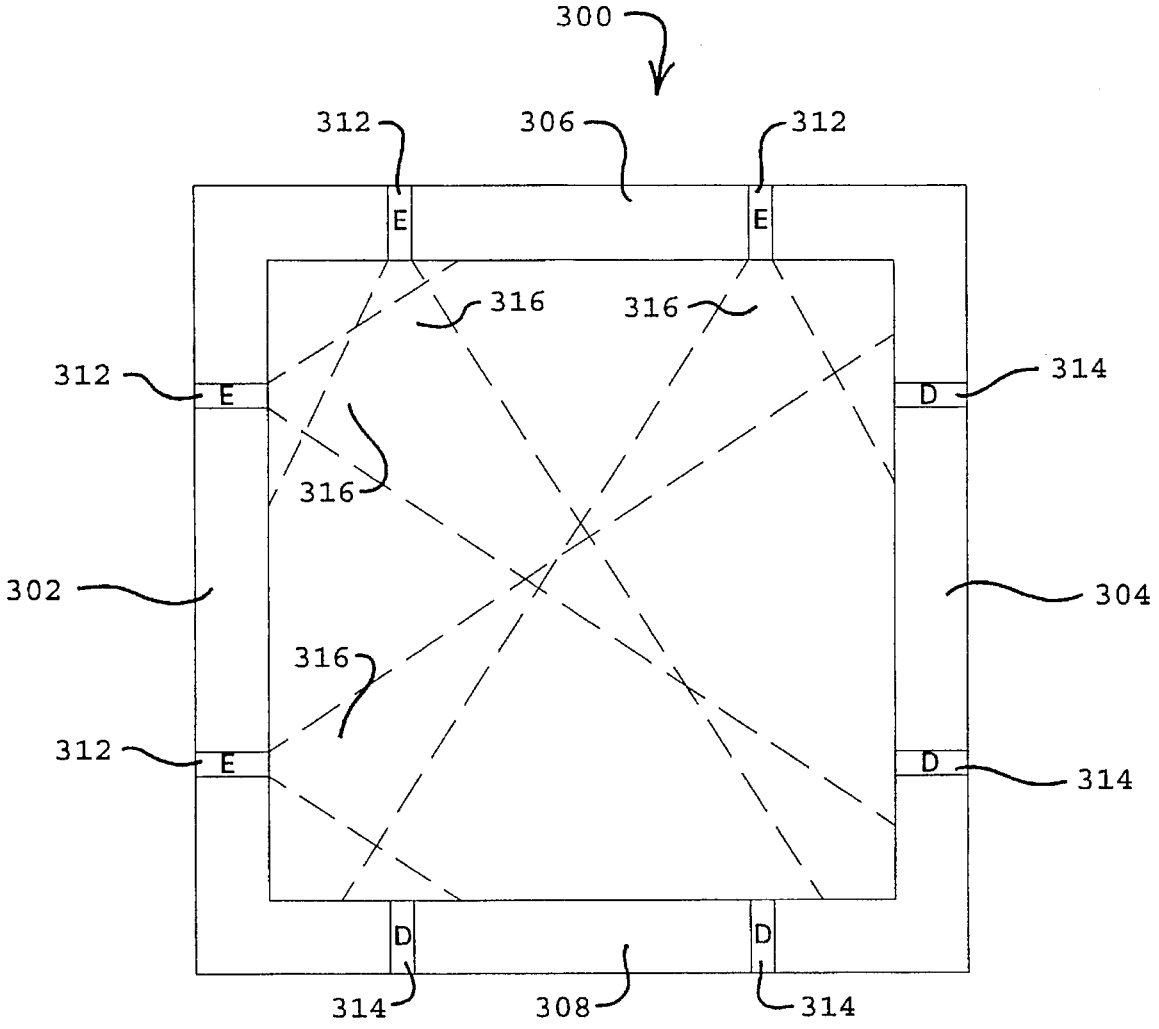
FIG. 13 is a front view of a chronograph light panel according to the present invention.

A second light panel 16 is positioned between the first light panel 14 and the gun G in one aspect at a known distance (stored e.g. in the computer's memory and/or the systems' electronics and accessible therein) from the first light panel 14. A bullet passing through an array of light beams of the second light panel 16 generates a signal indicative of the moment in time of passage of the bullet through the light panel. This signal is sent to the computer 20 and is processed as discussed below; e.g. this signal may be used to initiate a time period measurement or to start a timing clock. The light panels 14 and 16 are mounted within a housing 17 with a top 18 and a bottom 19. In one embodiment the panel 16 has only two pairs of emitter-detectors in each axis (vertical and horizontal) as shown in FIG. 13. Instead of using the first and second light panels to create and generate signals corresponding to time of projectile passage therethrough to determine velocity, a third light panel (not shown) is used, in certain embodiments, in conjunction with the second light panel for this purpose. In another embodiment the panel 16 has only a single emitter which illuminates a plurality of detectors (see e.g. FIG. 18).

A target screen roll 22 (or alternatively a fan-folded sheet stack of target material) is positioned in the top 18 of the housing 17 and the target screen 12 is fed through a hole 24. The target screen is re-wound on another roll 26 and fed to it through a hole 28 in the bottom 19 of the housing 17. A roll drive mechanism 30 rotates the roll 26 pulling the target screen 12 from the roll 22. A power cable 32 connects the mechanism 30 to an electronic controller, power supply, and computer interface device 34. A cable 36 interconnects the interface device 34 and the computer 20. A cable 38 interconnects the light panel 14 and the interface device 34. A cable 42 interconnects the light panel 16 and the interface device 34. A cable 44 interconnects a video projector 40 and the interface device 34. A cable 46 interconnects a sight device S of the gun G and the computer 20. A cable 47 interconnects a speaker 52 and the computer 20. A cable 45 interconnects a printer P and the computer 20. A monitor M is interconnected with the computer 20 and a cable 43 interconnects the computer 20 with a keyboard K. The printer P has a power cord 56. The computer 20 with the interconnected monitor M has a power cord 57. The movable sight mount T has a power cord 55. The interface device 34 has a power cord 54. Each power cord plugs into a suitable power supply (not shown). In one aspect of this invention instead of using a video projector to project a target image a preprinted target is used and a light source illuminates the preprinted target. "Computer monitor", "monitor" and "computer terminal screen" include, but are not limited to, cathode-ray tube (CRT) computer monitors, liquid crystal display (LCD) flat-panel computer display screens, advanced flat-panel computer display screens, video projector-based computer display screens, or any type of video display device or apparatus that may be interconnected with a computer for the purpose of displaying graphic information or data to a user. "Computer keyboard" and "keyboard" include, but are not limited to, any type of user interface device by which a user communicates with a computer, including alphanumeric keyboard, keypad, mouse, trackball, joystick, CRT touch input panel (touchscreen), scanner, bar code reader, modem, and voice recognition interface microphone with associated voice recognition computer software.

A bullet trap 50 is positioned behind the target screen 12 to stop and trap bullets passing through the target screen 12. The bullet trap 50 may be secured to the housing 17 or suspended behind it. This trap in one embodiment is made from thick steel plate or heavy steel mesh and, in one aspect, is curved away from the housing 17. A bulletproof shield 48 with a bottom portion 49 protects the housing 17 and its contents. In one embodiment the shield 48 is made from heavy steel plate or mesh. In another embodiment, the shield 48 has hollow internal cavities filled with energy absorbing material (e.g. sand). In one aspect shock absorbers 51 are mounted between the shield 48 and the housing 17; shock absorbers 52 between the rear of the housing and the trap 50; and a shock absorbing mount 53 supports the trap 50 from the top of the housing. Preferably the housing 17 is made from bullet-resistant or bulletproof material; in one aspect such material is capable of stopping deflected or ricocheting bullets. In housing areas where devices are to be protected from stray projectiles, but where provision is made for the transmission of light (e.g. light panels 14 and 16), bulletproof glass or acrylic material may be used to shield these devices.

In one embodiment the computer 20 stores a plurality of target images in its memory ("memory" including any type of computer-accessible storage media device interconnected to the computer system). A shooter selects an image to be projected on the target screen 12 by inputting a command into the computer 20 with the keyboard K. The selected image is sent via the cable 36, to the interface device 34, through the cable 44, and to the video projector 40. The video projector 40 projects the selected image through a lens 66, onto a mirror 62, through a lens 64, and then onto the target screen 12. Additional lenses, mirrors etc. are used to reduce or eliminate distortion of the image on the target screen 12 and the computer itself can modify the image to reduce/eliminate distortion of the image as projected. In another aspect the projector projects an image directly onto the target screen. In another embodiment, the target screen 12 has target images printed thereon and the video projector 40 or another light source illuminates the target upon command from the computer 20. The computer 20, upon request or automatically signals the monitor M to display and signals the printer P to print out a copy of the image as it appears on the target screen 12.

Following a shot, with the data provided by the signals from the two light panels 14 and 16, the computer calculates and stores the velocity of a bullet and the location of its point of impact on the target image on the target screen 12 (or alternatively electronics within or adjacent the light panels calculates actual bullet velocity and transmits the velocity value to the computer 20 along with X-Y coordinates for the bullet). The computer 20 then, either upon request or automatically, signals the monitor M to display the point of impact on the target image on the monitor and, upon request or automatically, signals the printer P to print out a copy of the target image with an indication of the point of bullet impact.

Upon request or automatically the computer 20 compares actual bullet performance data to known ballistic data and parameters which are stored in the computer's memory for use and for display. For example, a shooter according to one method of the present invention inputs details and data about the shooter's gun (caliber, barrel length, type-rifle, revolver, etc.) and ammunition (caliber, bullet weight, bullet type, etc.), the distance to the target, and atmospheric conditions. The computer uses "look up" data tables and equations relating the particular gun, the particular ammunition, and the shooting conditions and calculates a theoretical predicted bullet velocity which it announces in audio and/or displays on the monitor and/or prints out in hard copy. Upon request or automatically the computer 20 displays on the monitor M data for the bullet in tabular or graphical format. The computer 20 stores data (bullet velocity, location, score for each shot) and calculates and displays the data for a plurality of shots. If desired, a shooter commands the computer to store each entire target screen image after each shot or after a group of shots. For target images which have areas with different scores, the computer 20 receives signals indicative of bullet impact location and converts each such signal to a score; adds the scores for multiple shots; averages them; and, either upon request or automatically at any point in the process or when it is complete displays these results in a desired format on the monitor M and/or has the printer P provide them in a printed copy. The computer 20 also processes scores for multiple shooters at multiple target images and displays results as described and prints them as described. The computer 20 (automatically or upon request) calculates, stores, and displays, and/or prints average velocity; high, low, and extreme spread velocity; and velocity standard deviation for a plurality of shots and shot group size for a plurality of shots. The computer calculates and displays other factors relating to a bullet: e.g. (a) kinetic energy of bullet at target; (b) momentum of bullet at target; and (c) power factor of bullet at target. Then, knowing the distance to the target and the shooting conditions, the computer corrects the factors to give values at the gun's muzzle; e.g. (a) muzzle velocity, (b) muzzle energy, and (c) muzzle momentum.

The computer 20 controls both the video projector 40 and the target screen roll drive mechanism 30 and, as desired, produces moving target images on the target screen 12 using appropriate moving target image software. The computer controls interconnected storage media devices (e.g. CD-ROM drives, laser disk players) containing moving (or still) target images and causes the desired target image to be transmitted to the video projector 40 and monitor M at the appropriate time. In another embodiment the computer 20 controls the target screen roll/sheet drive mechanism and the target screen illumination light(s) that illuminate target screen material with target images printed thereon.

Figure 14:
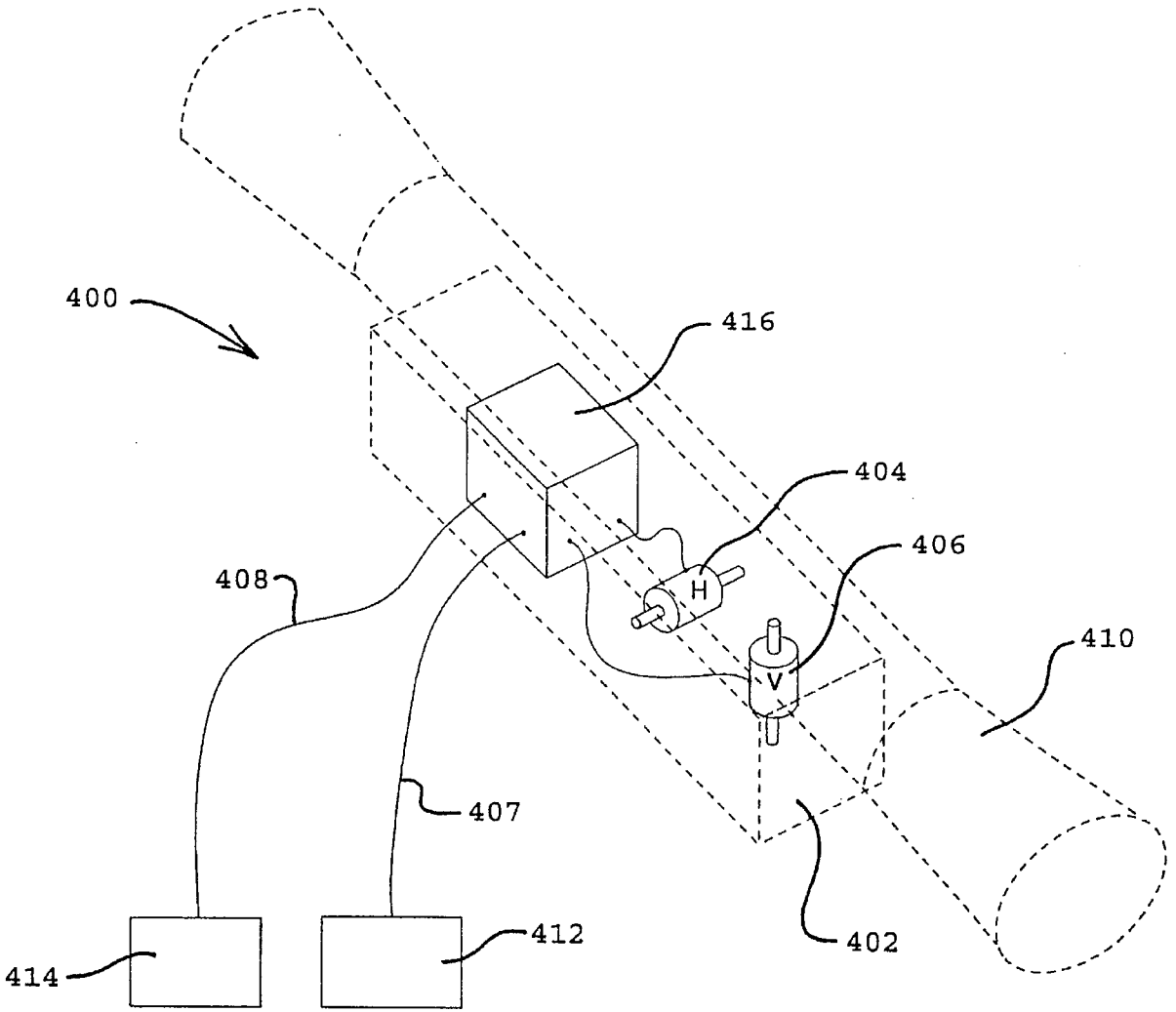
FIG. 14 is a perspective schematic view of a computer-controlled sight according to the present invention.

In one embodiment the computer-controlled sight S has a system of miniature electric servomotors and screw/rotary drive mechanisms which rotate horizontal and vertical sight adjustment "screws" on the sighting device upon receiving adjustment signals from the system computer. The portion of the device which contains the servomotors and drive mechanisms may be either: an integral part of the overall sighting device and/or its base or mounting bracket, such that the servomotor system remains a part of the sighting device and projectile launch system at all times during use; or contained in a separate enclosure that is only connected/attached to the sighting device during the adjustment or "sighting-in" procedure. FIG. 14 shows schematically one such computer-controlled sighting device, described below. ("Servomotor" includes servomotors, stepper motors, small motors, step motors, hybrid servomotors and stepping servomotors.)

In one embodiment the audio system includes the speaker 52, computer interface cable 47, user headset 59, headset cable 58, and a sound card (not shown) in the computer 20 to provide appropriate output signals to the audio devices. The computer used in systems according to this invention may use any type of computer-accessible storage media, e.g. magnetic or optical, including laser optical devices, laser disk, CD-ROM, digital audio/video disk, digital audio/video tape, magnetic disk or magnetic tape. Computer software used in systems according to this invention take X-Y coordinate input signals from the light panel (e.g. panel 14) and calculate and display location of bullet impact. Actual bullet velocity is calculated from known travel time between two light panels and distance of panel spacing (e.g. between the panels 14 and 16).

Due to the precision of the light panels, a bullet passing along a path identical to that of a previous bullet is sensed by the light panels and its position is accurately noted and stored.

Figure 3:
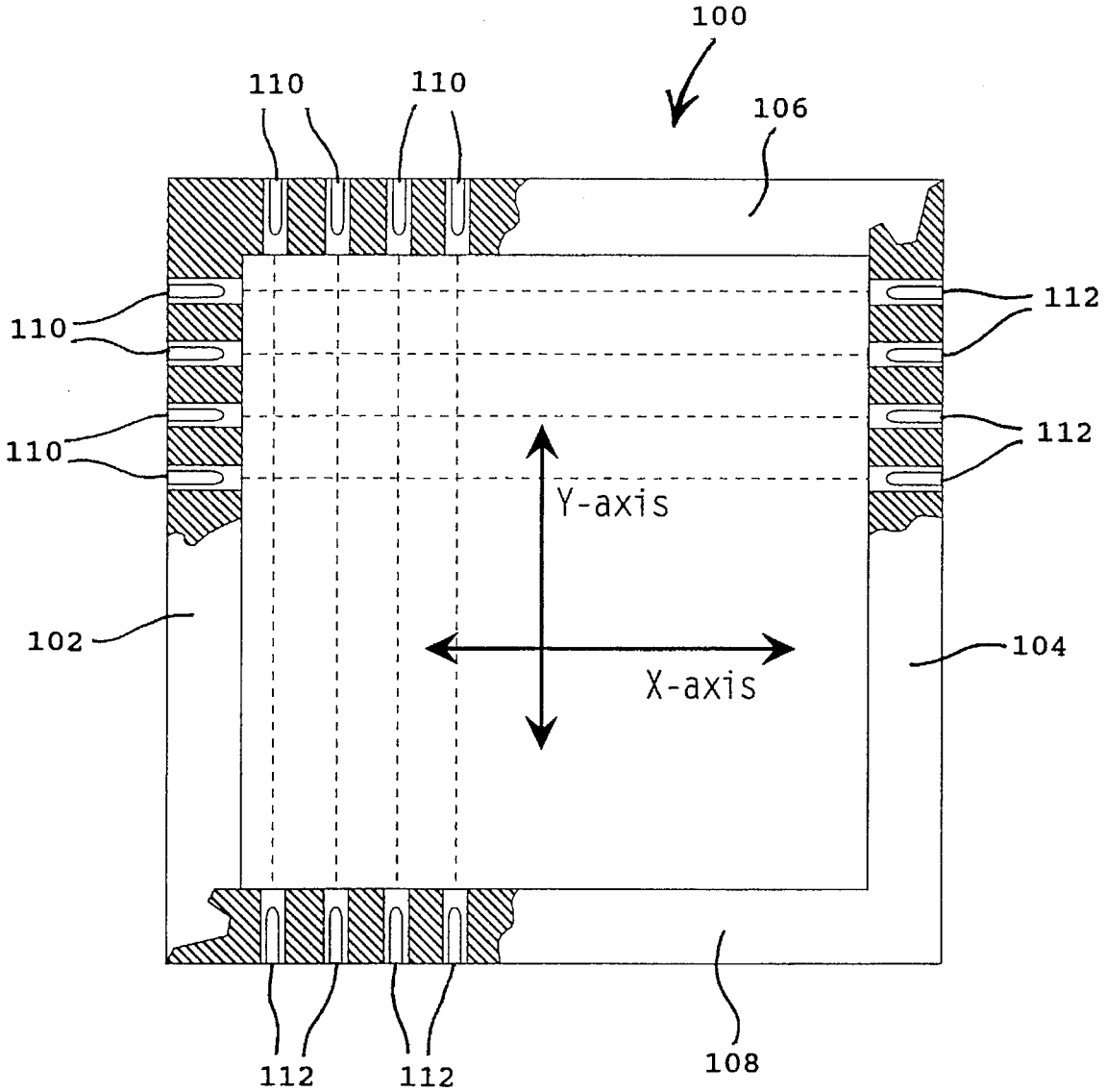
FIG. 3 is a front view of a light panel according to the present invention, partially cut-away.

FIG. 3 illustrates a light panel 100 according to the present invention (e.g. panel 14) which has vertical sides 102 and 104 and horizontal sides 106 and 108. A plurality of light emitters (four shown in cutaway on each side) 110 are mounted in the vertical side 102 and the horizontal side 106; and a plurality of light detectors 112 are mounted in the vertical side 104 and the horizontal side 108. Preferably emitters and detectors extend along the length of each respective side. (A "light panel" in any embodiment herein may be a matrix light panel, an X-Y coordinate light panel, an impact coordinate light panel, or a light panel utilizing emitters which emit fan-shaped light beams, e.g. in a plane.)

Figure 4:
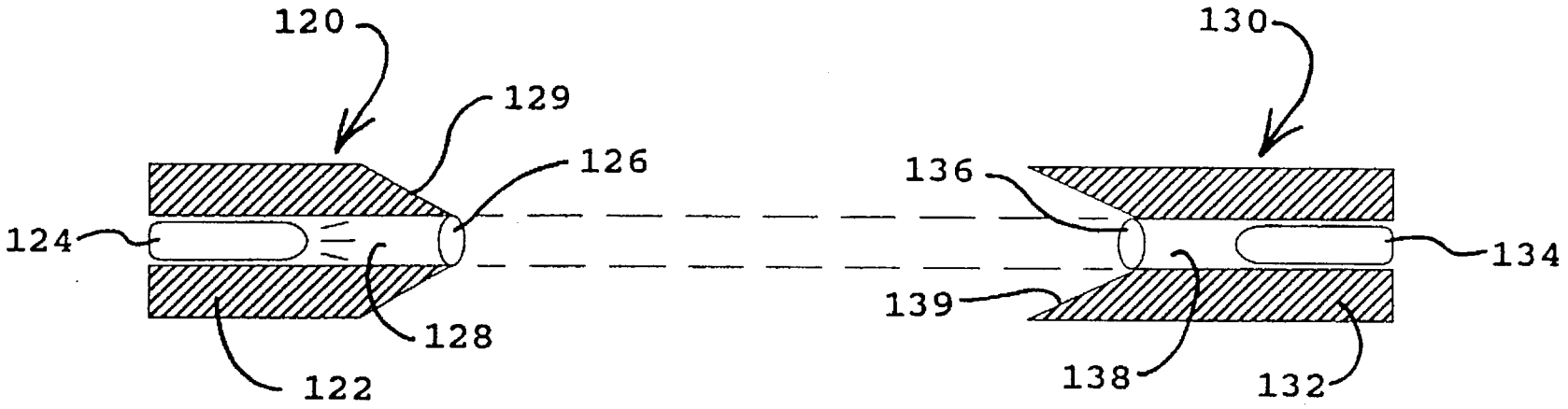
FIGS. 4 and 5 show, in cross-section, emitter-detector pairs useful with the panels of FIGS. 3 or 6.

FIG. 4 illustrates an emitter mount 120 according to the present invention with a body 122; a channel therethrough 128; a light emitter 124; a focusing lens 126 mounted in the channel 128; and a convex surface 129 at one end of the body 122. FIG. 4 also illustrates a detector mount 130 according to the present invention with a body 132; a channel 138 therethrough; a focusing lens 136; a light detector 134 mounted in the channel 138; and a concave surface 139 at one end of the body 132.

Figure 5:
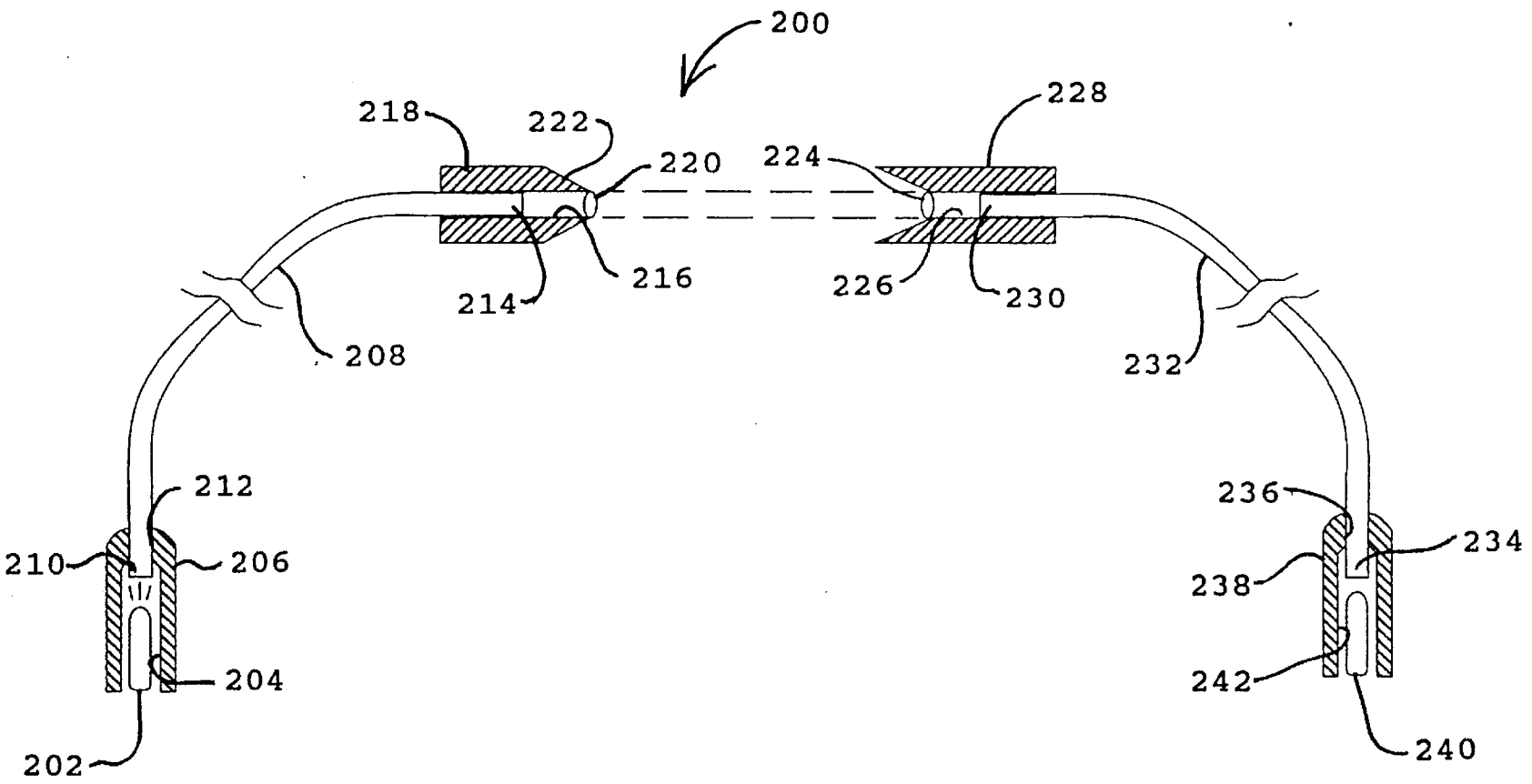

FIG. 5 illustrates an alternative emitter-detector system 200 according to the present invention. A light emitter 202 is disposed in a channel 204 of a body 206. A fiber optic 208 has one end 210 which passes through a hole 212 in the body 206 and another end 214 disposed in a channel 216 in a body 218. A focusing lens 220 is disposed in an end 222 of the channel 216. Light from the emitter 202 passes down the fiber optic 208, to and through the lens 220 and thence across to a focusing lens 224.

The focusing lens 224 is disposed in a channel 226 of a body 228 in which is also mounted an end 230 of a fiber optic 232. An end 234 of the fiber optic 232 extends through a hole 236 of a body 238. A light detector 240 is mounted in a channel 242 of the body 238 so that light passing through the lens 224 passes through the fiber optic 232 to the light detector 240.

Figure 6:
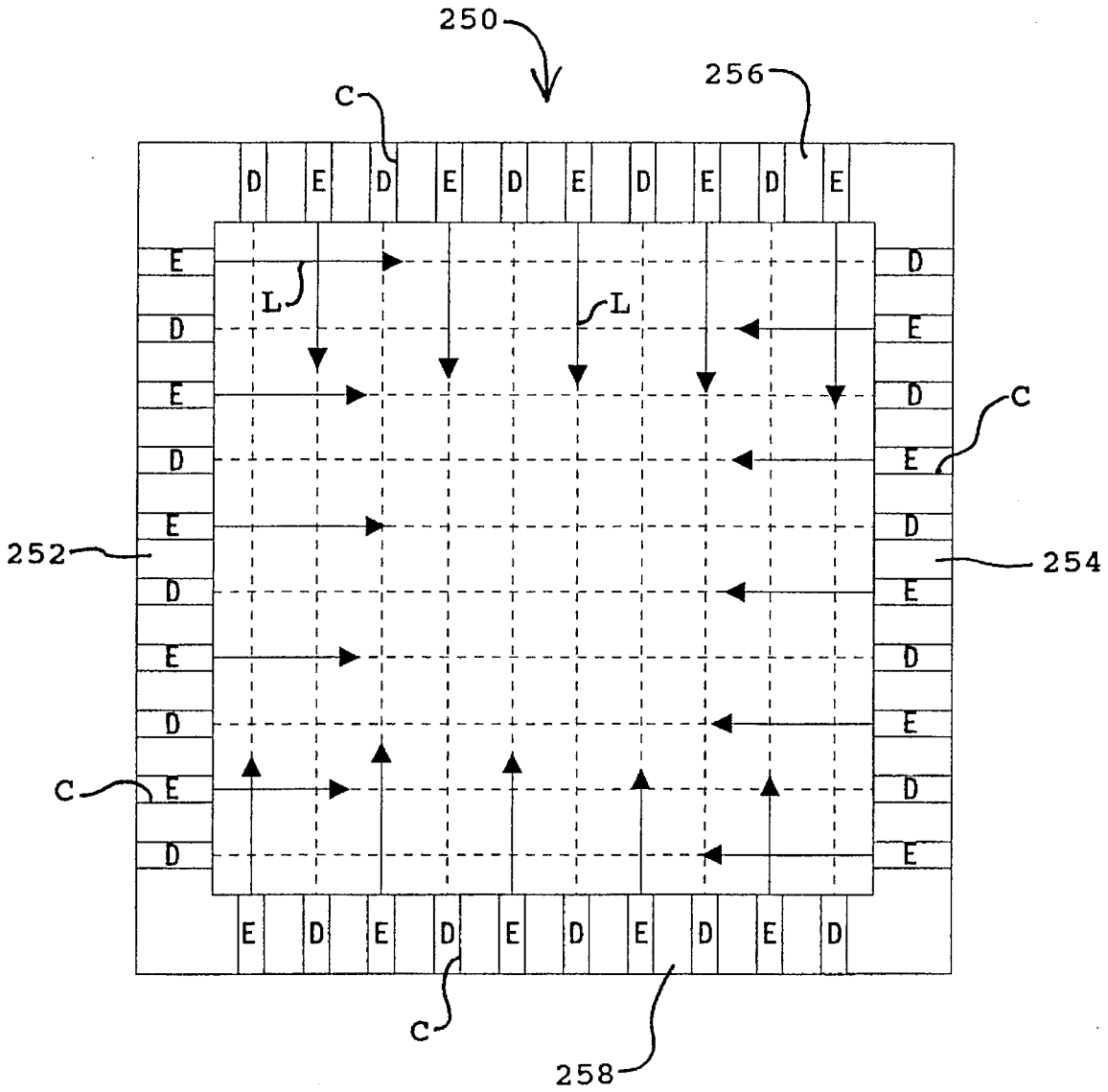
FIG. 6 is a front view of a light panel according to the present invention.
Figure 7:
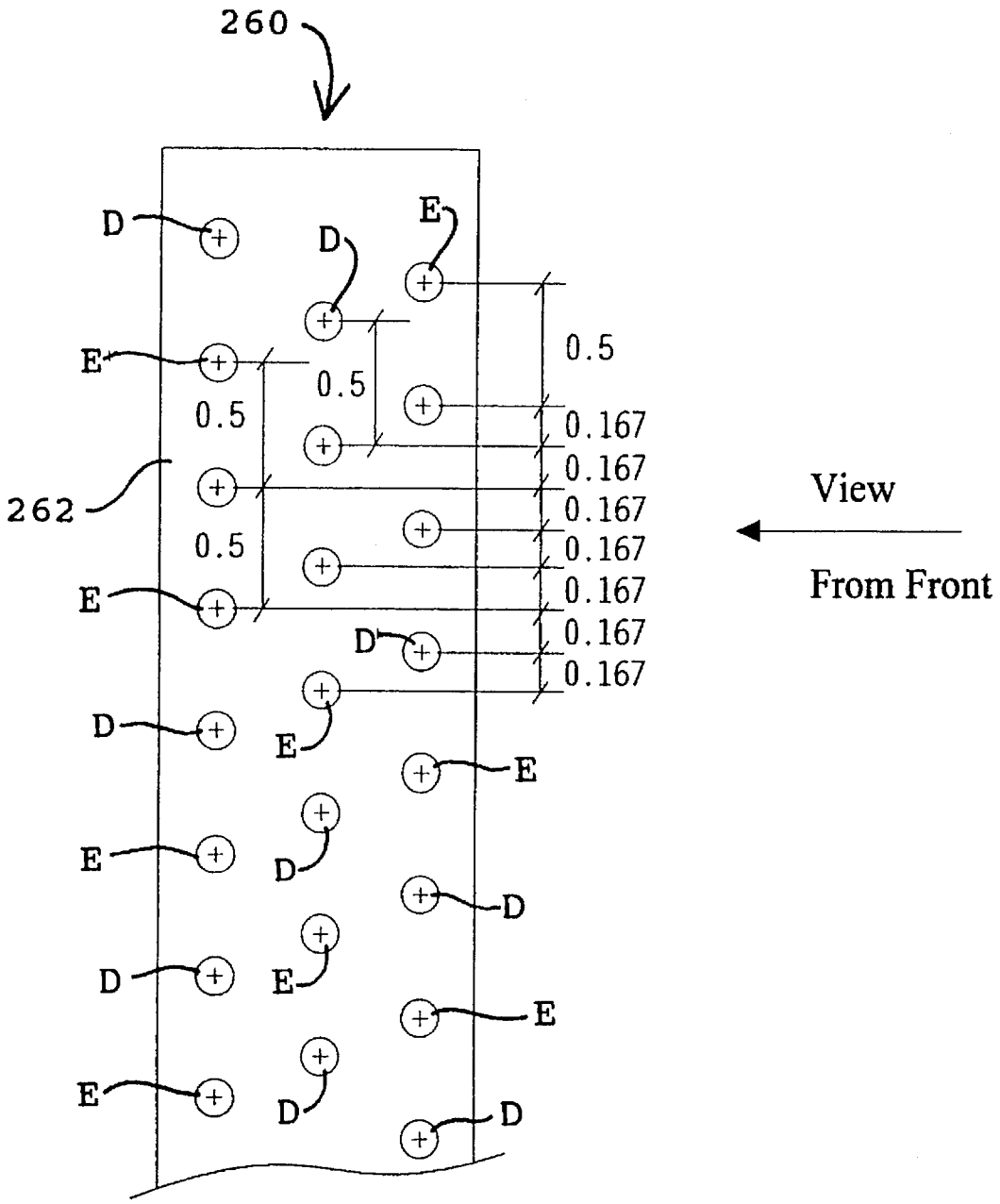
FIG. 7 is a side cross-sectional view of a side of a panel like that of FIG. 6.

FIG. 6 illustrates a light panel 250 (like the panel 14) according to the present invention which has vertical sides 252 and 254 interconnected by horizontal sides 256 and 258. Light emitters E and detectors D are alternately positioned in channels C in each side so that a light beam L from an emitter on one side strikes a corresponding detector on an opposing side. As shown in FIG. 7, in a light panel 260 according to the present invention which is similar to the panel 250, each panel side, e.g. as the one panel side 262 shown, may have a plurality of rows of emitters E and detectors D with opposing panel sides having corresponding rows of detectors and emitters. It is within this invention's scope for vertical columns of devices as shown in FIG. 7 to have emitters and detectors alternating from top to bottom. In one embodiment of a light panel according to this invention, all emitter-detector pairs are simultaneously energized. In other embodiments, emitter-detector pairs are energized sequentially and/or in groups to create the continuous presence of planes of collimated light beams through which the projectile passes. Alternate emitter-detector positioning and spacing, the use of different frequency/wavelength and/or alternately polarized light for adjacent emitter-detector pairs, as well as the use of lenses (e.g. but not limited to polarizing lenses), assist in isolating one beam from another so that a detector senses only light from its associated emitter. Control/interface electronics (ambient light compensating circuits, automatic fault detection circuits, interrupted light beam detecting circuits, digital microprocessing circuits) are used to sense, calculate and transmit X-Y coordinate signals from a light panel's interrupted light beams to the system computer.

Light panels according to the present invention may have light emitter-detector pairs located in a variety of ways, including: individual emitters and individual detectors both located on a light panel frame; individual emitters and individual detectors both located remote from the frame with fiber optic cable used to transmit the light signals to and from the precise rectangular (X-Y) or angular coordinate frame positions; individual emitters located on the frame with individual detectors located remotely with fiber optic cable; individual emitters located remotely with fiber optic cable and individual detectors located on the frame; large, common emitters serving several frame coordinate positions, located on the frame with individual detectors located on the frame; large, common emitters serving several frame coordinate positions, located on the frame, with individual detectors located remotely with fiber optic cable; large, common emitters serving several frame coordinate positions, located remote from the frame with fiber optic cable, with individual detectors located on the frame; large, common emitters serving several frame coordinate positions, located remote from the frame with fiber optic cable, with individual detectors located remotely with fiber optic cable.

In certain embodiments, light panels according to the present invention use light sources and detectors which operate at any frequency/wavelength, including ultraviolet, visible, and infrared, with appropriately matched emitter-detector devices "Emitters", "light emitters" and "light sources" used in light panels according to certain embodiments of the present invention include any device or apparatus capable of emitting or producing light, although they may not be equivalents of each other. "Detectors", "light detectors" and "light sensors" used in light panels according to certain embodiments of the present invention include any device or apparatus capable of detecting or sensing light, although they may not be equivalents of each other. "Light" and "light beams" include all forms of electromagnetic radiation including radio waves, microwaves, radar, infrared light, visible light, ultraviolet light, x-rays and gamma rays. In certain embodiments, light polarization techniques are used in light panel emitter-detector systems.

Figure 8:
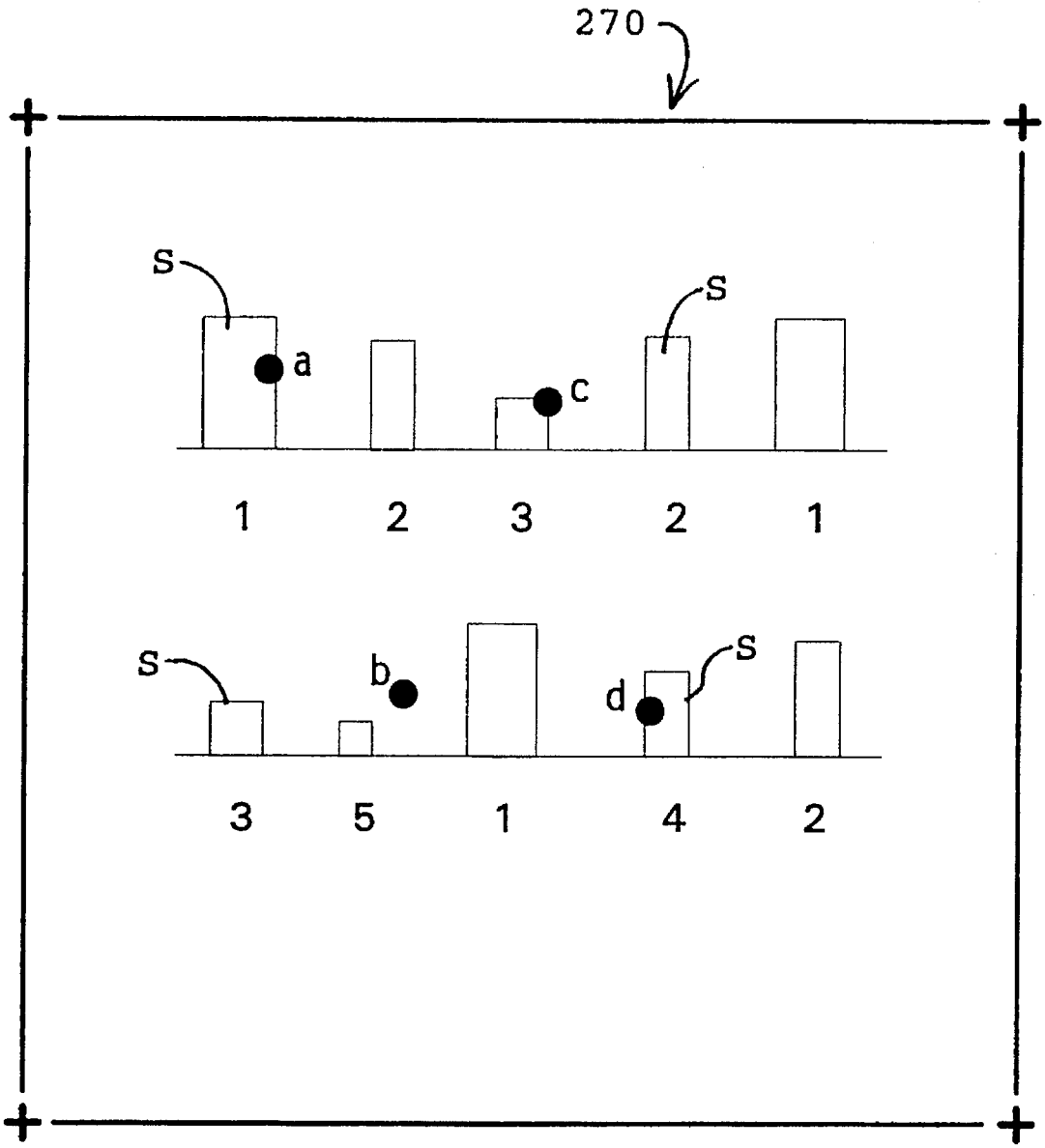
FIGS. 8 and 9 illustrate target images projected on a target screen, preprinted on target screen material, and/or displayed by a system monitor according to the present invention.
Figure 9:
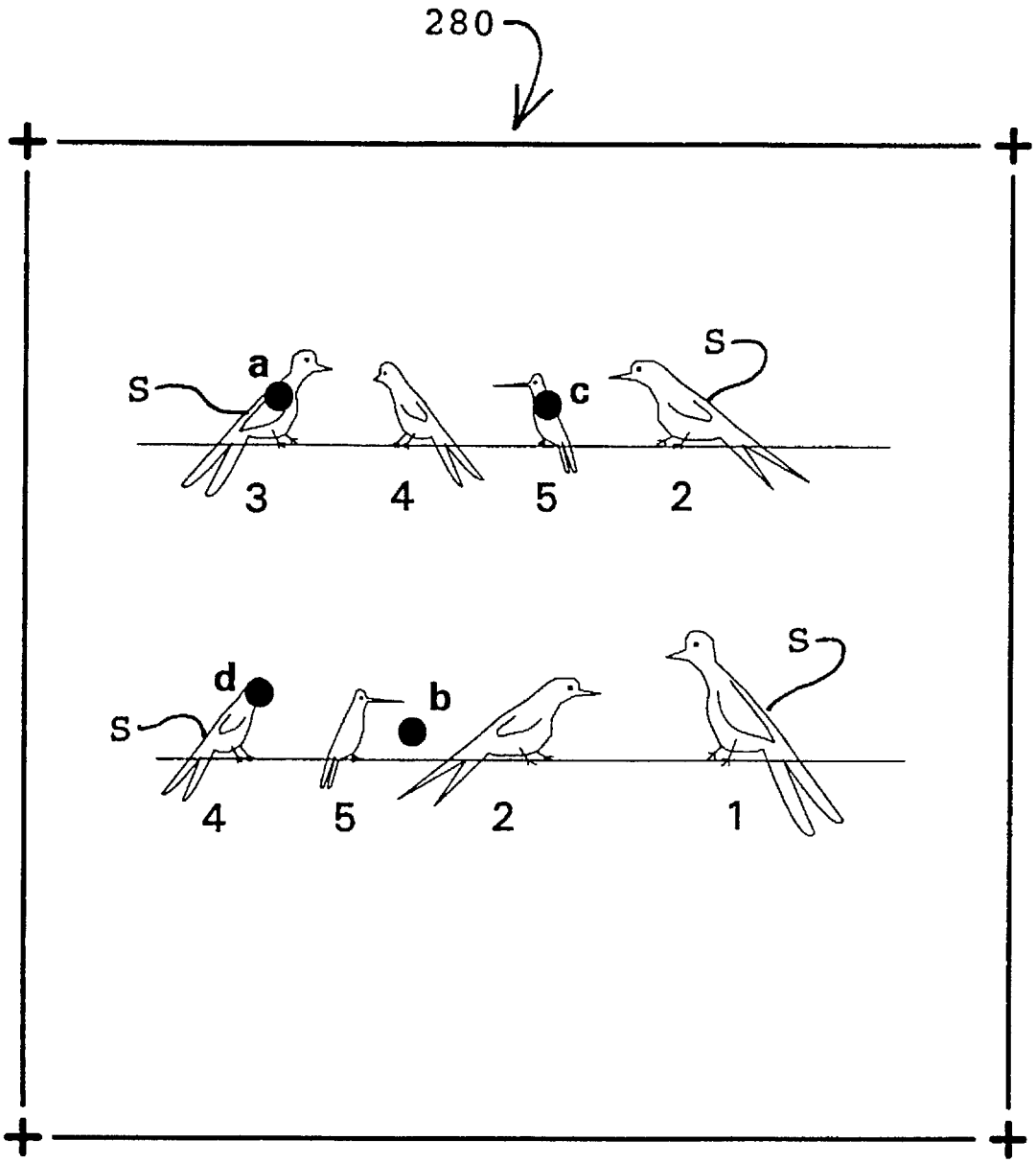
Figure 10:
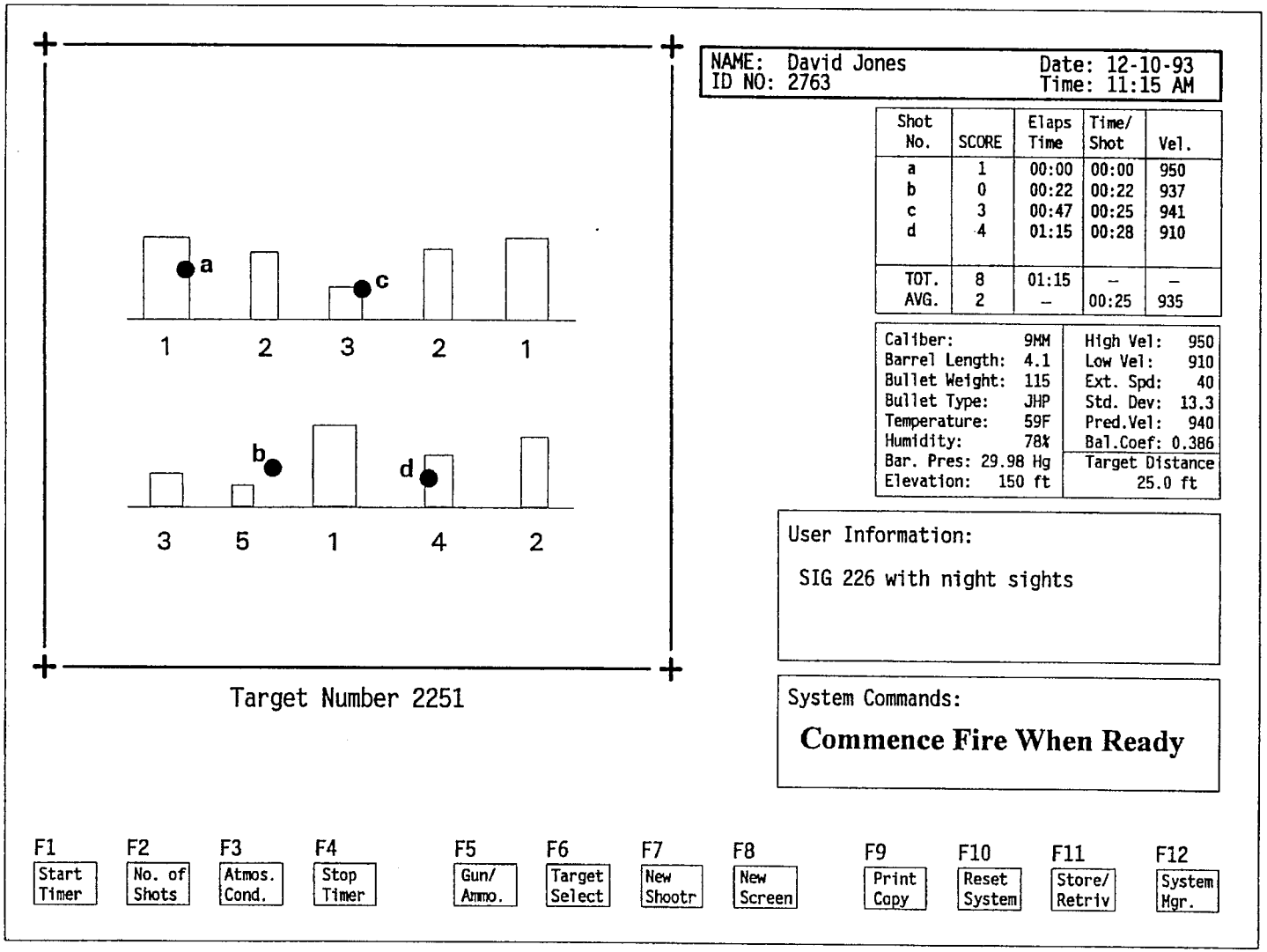
FIG. 10 illustrates both a monitor image and a printed copy of data for a shooter produced by a system according to the present invention.

FIGS. 8 and 9 illustrate video (or preprinted) target images 270 and 280 (which may also be printed out by the printer in a hard copy) respectively which show sub-images S of different size and of different shot point value (indicated by numerals 1, 2, 3, 4, 5), and multiple bullet impact points a, b, c, d. FIG. 10 illustrates both a monitor M image of the shooting comprising shots corresponding to bullet impact points a, b, c, and d as well as a paper print out of the same image. As shown, the computer notes each shot by designation a, b, c, d; each shot's point value; a total score; an average score; a time and date; a shooter by name—"David Jones"; a shooter number—"ID No. 2763"; a predicted bullet velocity; shot timing and time per shot; an actual velocity for each shot; average, high, low and extreme spread velocity; a velocity standard deviation; atmospheric conditions; gun/ammunition information; and distance to target. Pressing an indicated softkey on the computer keyboard initiates a stated function or initiates display of stated information on the monitor M.

Figure 11:
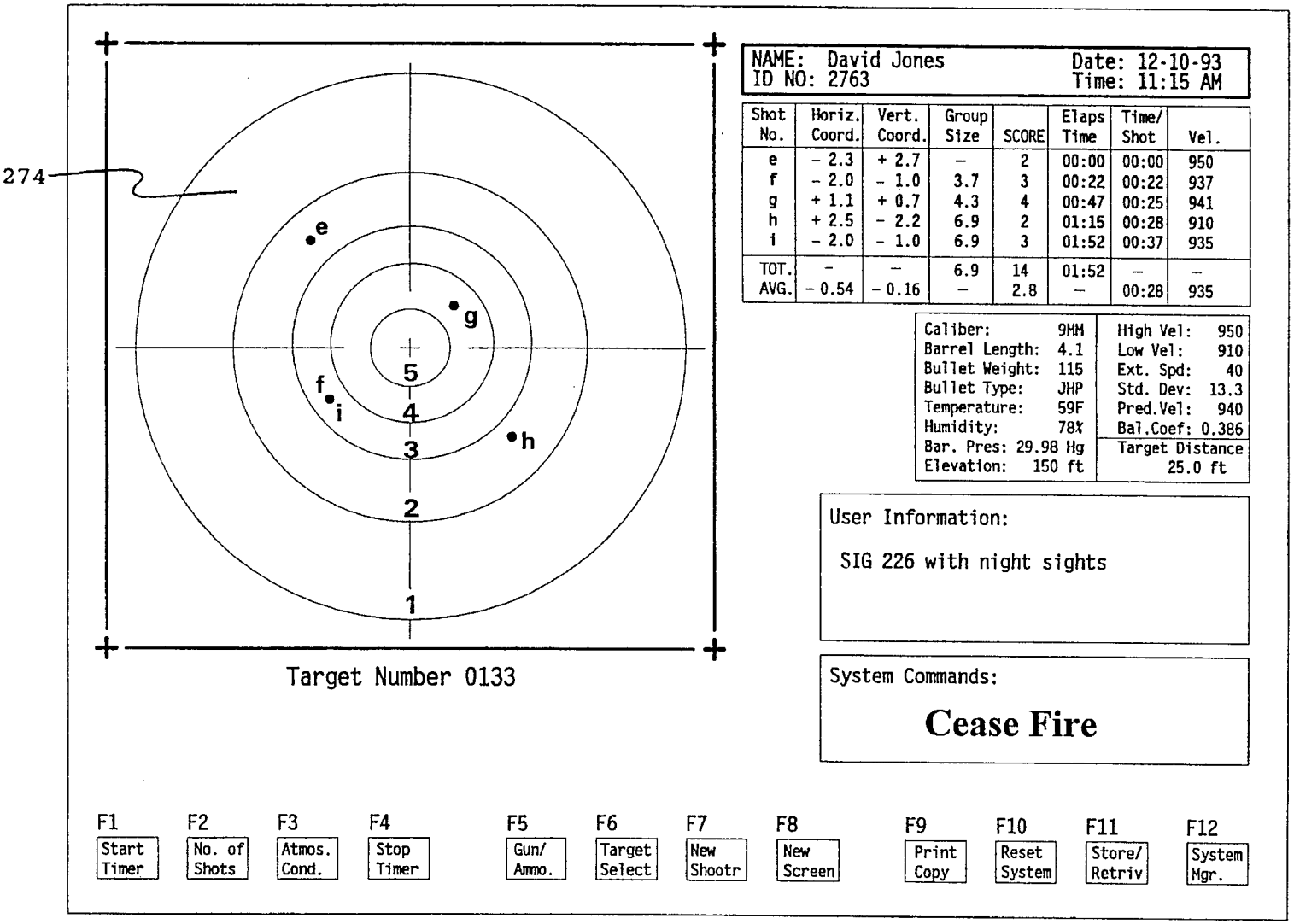
FIG. 11 illustrates both a monitor image and a printed copy of data for a shooter produced by a system according to the present invention.

Similarly, FIG. 11 illustrates a typical bullseye video image 274 projected on a monitor M, and/or printed on paper—with different point value areas 1, 2, 3, 4, 5 and with actual bullet impact points e, f, g, h, i. FIG. 11 illustrates a variety of data and information corresponding to the shots e, f, g, h, i, stored, presented, and/or calculated by the computer, including: shooter number and name; time and date of shooting; shot indicators e, f, g, h, i; vertical and horizontal coordinates of bullet impact points (note i and f are identical in location); group size; point score; predicted bullet velocity; actual bullet velocity; average location; total score; shot timing and time per shot; average score per shot; average, high, low, and extreme spread velocity; and velocity standard deviation. Also shown are atmospheric conditions, gun/ammunition information, and distance to target.

FIG. 13 illustrates a chronograph light panel 300 (like the panel 16) according to the present invention with panel sides 302, 304 interconnected by panel sides 306, 308. Each side pair has two light emitter 312-detector 314 pairs. Emitter beams 316 from each emitter 312 are sensed by a corresponding detector 314. Chronograph light panels according to the present invention which sense the passage of a projectile through the panel (and not the X-Y coordinates of the projectile) may have relatively few pairs of emitters and detectors with light beams that are spread out and not collimated. Dotted lines in FIG. 13 indicate emitted non-collimated light beams.

FIG. 14 illustrates schematically an integral type computer-controlled sight (scope) 410 with a control adjustment apparatus 400 according to the present invention. A sight (scope) 410 is mounted to a mounting bracket 402 (which is mounted on a gun, not shown). One servomotor 404 interconnected between the mounting bracket 402 and the sight 410, moves the sight under control of a computer 412, in the horizontal direction. Another servomotor 406, interconnected between the mounting bracket 402 and the sight 410, moves the sight in the vertical direction. An electronic controller and computer interface panel 416 is interconnected between the computer 412 and the servomotors. A power cord 408 is connected to a power supply 414 and supplies power to the interface panel 416. A cable 407 interconnects the computer 412 and the interface panel 416.

Figure 15:
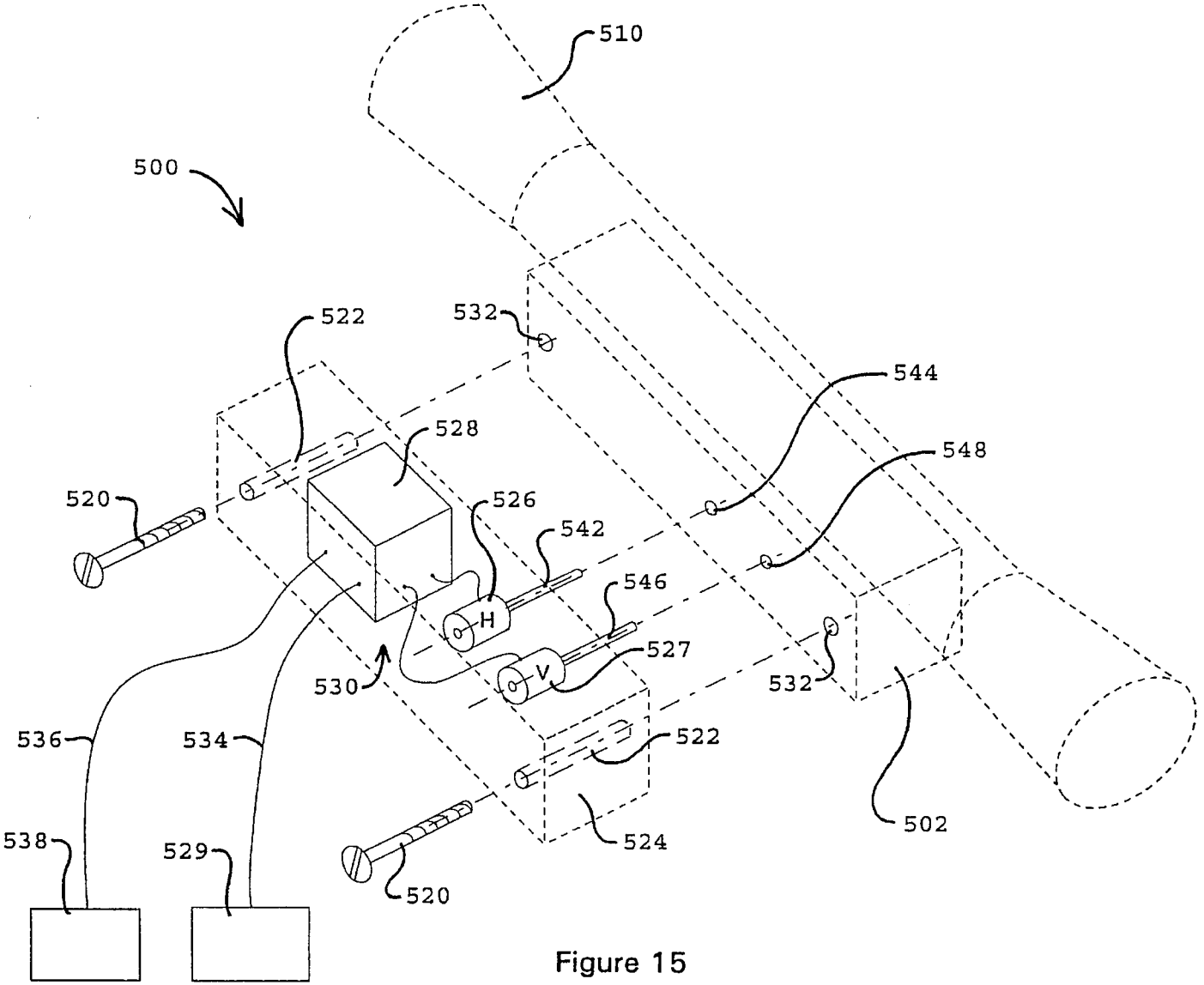
FIG. 15 is a perspective schematic view of a computer-controlled sight according to the present invention.

FIG. 15 illustrates schematically a detachable type computer-controlled sight adjustment apparatus 500 according to the present invention. A sight (scope) 510 is mounted to a mounting base 502. Using bolts 520 extending through holes 522 in a block 524 and through holes 532 in the mounting base 502, the sight adjustment device 530 is attached during the adjustment or sighting-in procedure. The base 502 is mounted to a gun (not shown) so that it is permitted some degree of motion in response to sight adjustment device 530 according to the present invention. The device 530 has an electronic controller and computer interface panel 528 within the block 524 which is interconnected between two servomotors 526 and 527 and a control computer 529. A computer interface cable 534 interconnects a computer 529 and the interface panel. A power cord 536 supplies power to the interface panel 528 from a power supply 538. The servomotor 526 has a shaft 542 which co-acts with a female coupling 544 in the base 502 (e.g. with a splined, threaded, or allen-wrench-type interconnection) to move the base 502 in the horizontal direction. The servomotor 527 has a shaft 546 which co-acts with a female coupling 548 in the base 502 to move the base 502 in a vertical direction.

Figure 16:
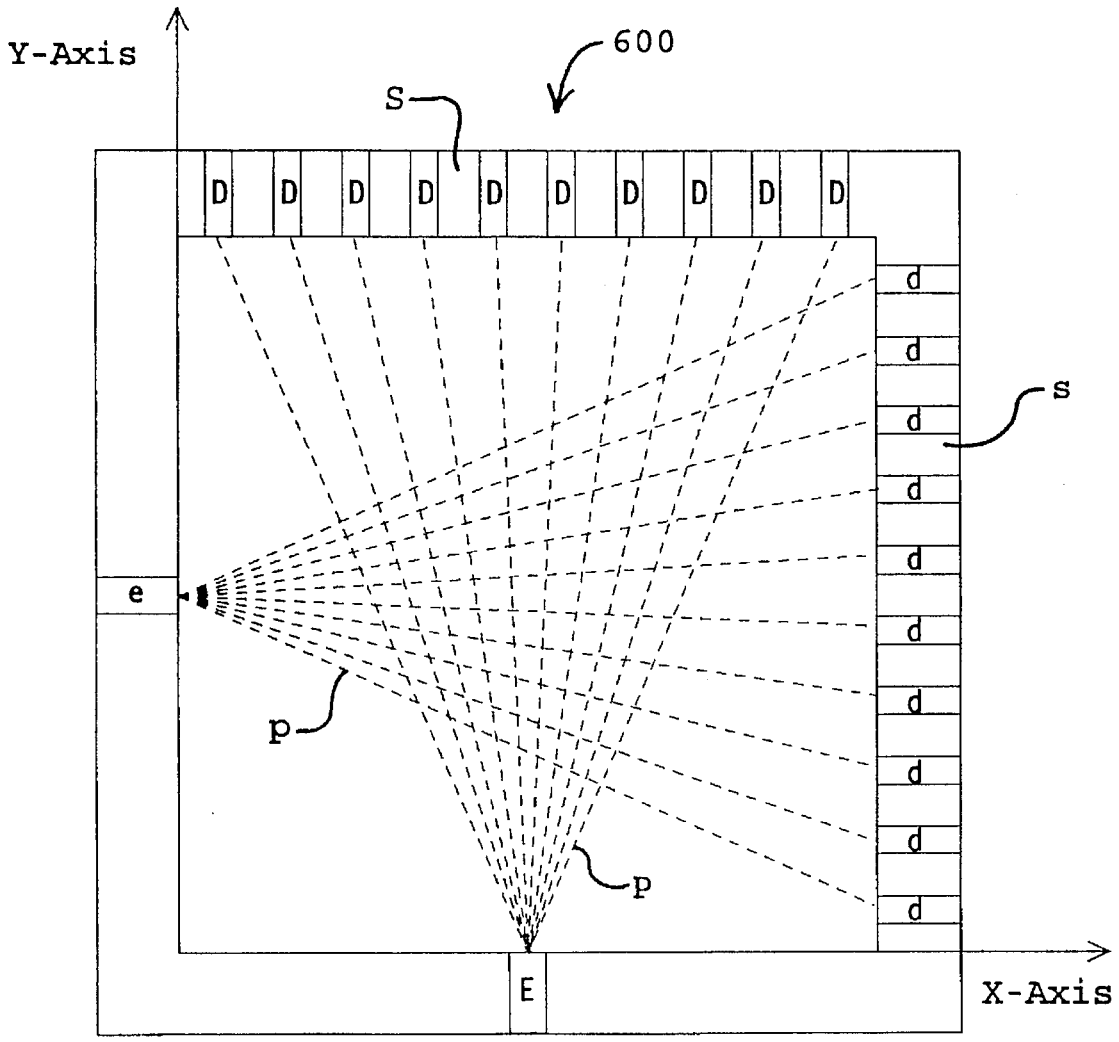
FIG. 16 is a front view of a light panel according to the present invention, partially cut away, with two light sources emitting fan-shaped planes of light.

FIG. 16 illustrates a light panel 600 according to the present invention which has two light sources (e and E) that emit fan-shaped planes p and P respectively of light beams towards opposite panel sides s and S respectively. A plurality of detectors (d and D) are located on the panel sides s and S opposite the emitters e and E, respectively. Radial light beam paths between emitters and detectors are indicated by dotted lines. Such a light panel is useful to detect and register the location of any object or objects (including but not limited to a bullet, arrow, ball, etc.) which passes through the panel's beams. Such a panel also is useful to detect the size and/or shape of the object(s).

Figures 17A, 17B:
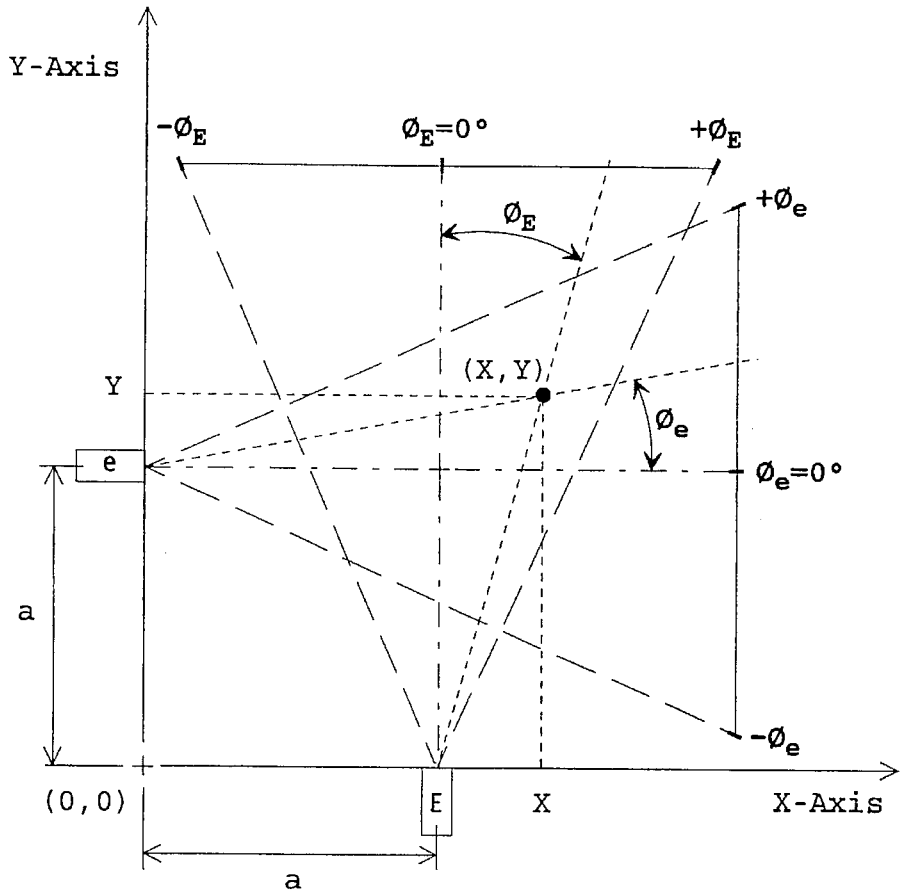
FIG. 17*a* illustrates the geometric layout of the light panel of FIG. 16 and the mathematical equations in FIG. 17*b* are used to calculate an X-Y coordinate of a bullet's path.

FIG. 17*a* illustrates the geometric configuration of the light beam paths that results from the emitter-detector arrangement of the panel of FIG. 16. $\phi_e$ and $\phi_E$ represent values for the angular (polar) coordinates of the radial light beam paths interrupted by a bullet passing through the panel frame. The mathematical equations of FIG. 17*b* illustrate a method of converting the angular (polar) coordinates of the interrupted beam paths to rectangular X-Y coordinates for a bullet passing through the point (X, Y).

Figure 18:
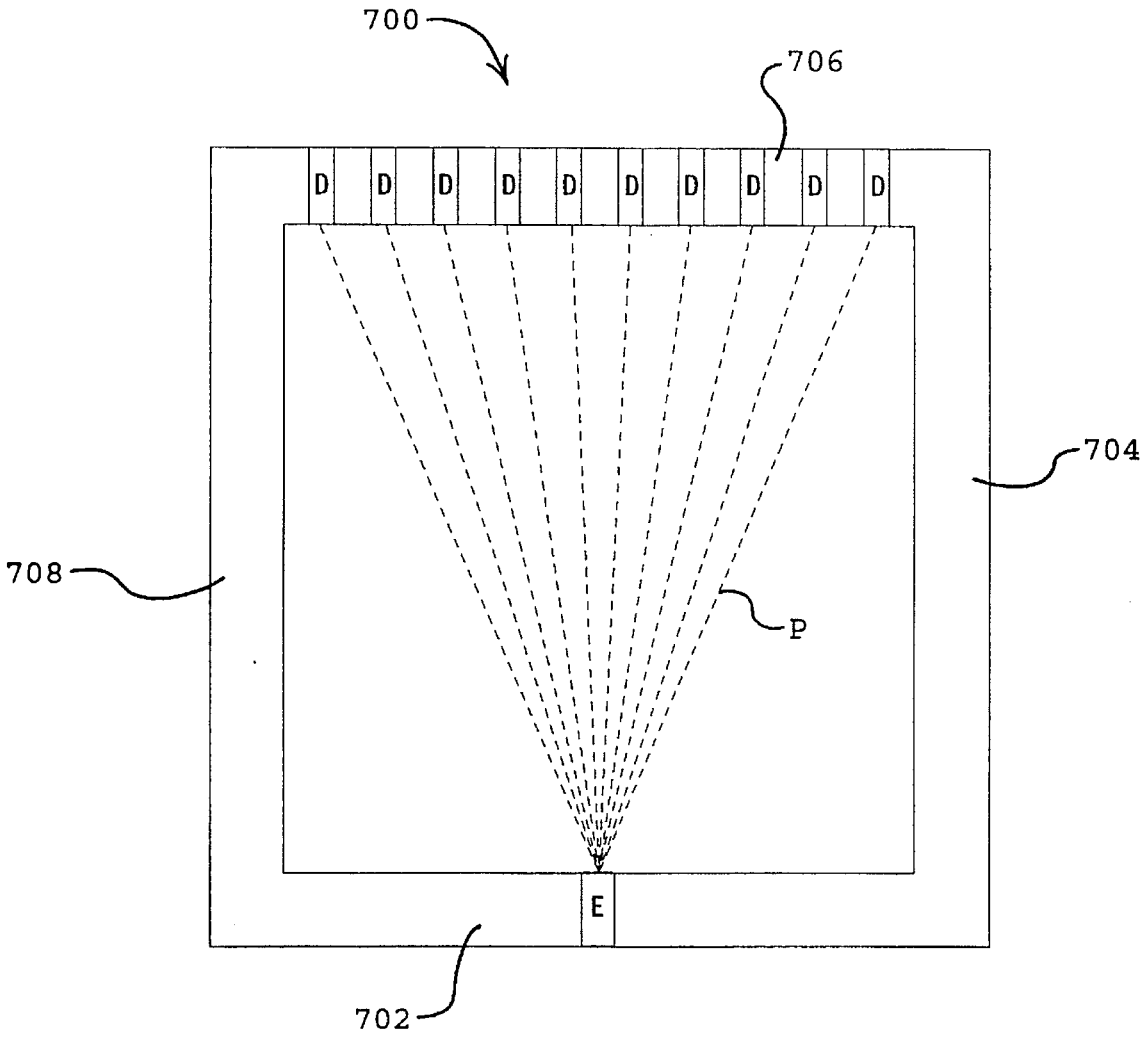
FIG. 18 is a front view of a chronograph light panel according to the present invention which uses a single light source emitting a fan-shaped plane of light.

FIG. 18 illustrates a chronograph light panel 700 according to the present invention with sides 702, 704, 706, 708 and has a single light source E in side 702 which emits a fan-shaped plane of light beams P towards a plurality of light detectors D located on an opposite side 706 of the panel frame. Radial light beam paths between the emitter and the detectors are indicated by dotted lines.

Figure 19:
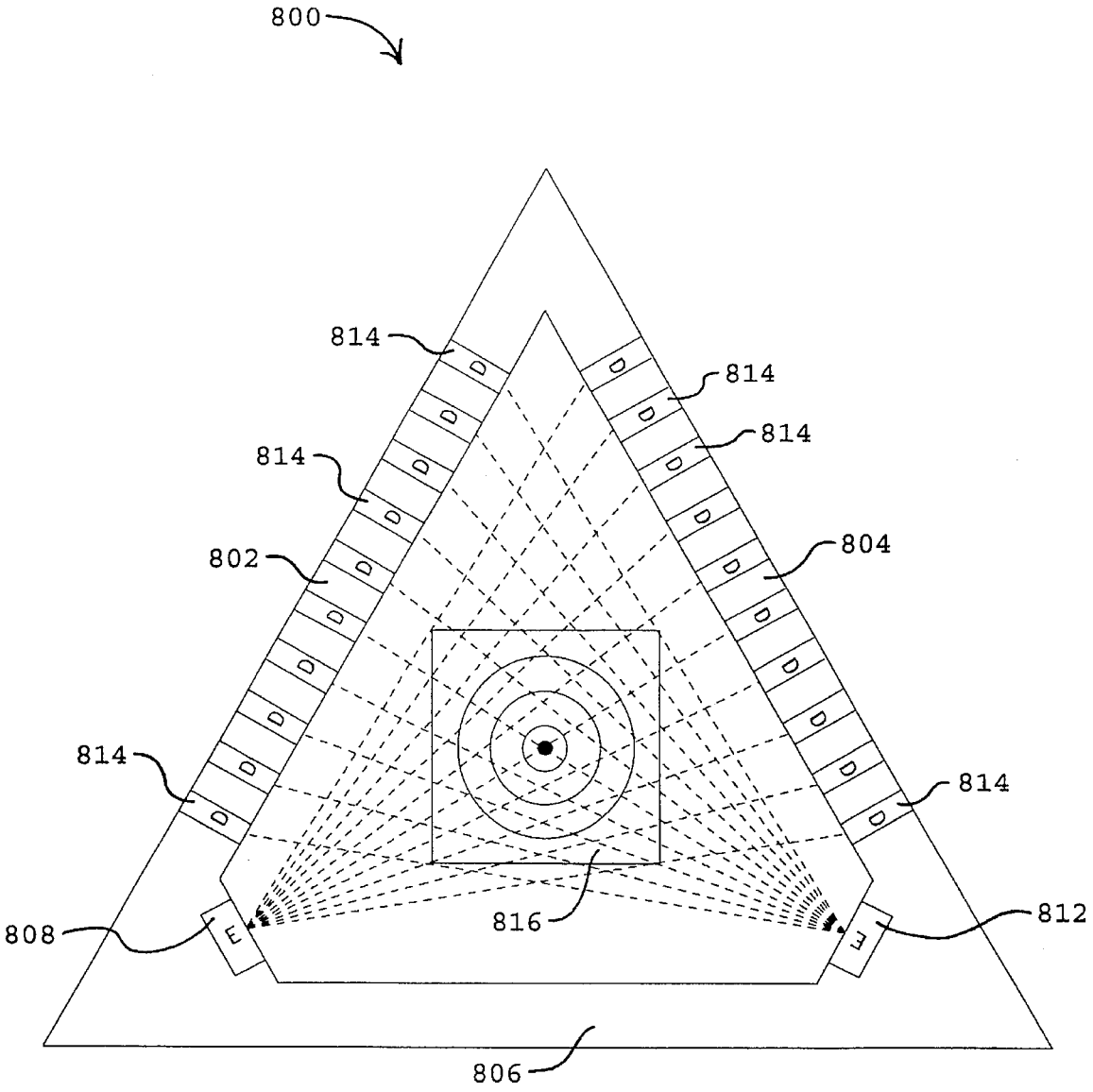
FIG. 19 is a front view of a light panel according to the present invention.

FIG. 19 shows a light panel 800 according to the present invention with three interconnected sides 802, 804 and 806. A first light emitter 808 is secured to or in the side 802

(and/or to the side 806) and a second emitter 812 is secured to the side 804 (and/or to the side 806). Each side 802, 804 has a plurality of light detectors 814 thereon or therein for sensing light from their corresponding emitter. The side 806 may be omitted. The light panel 800 is shown superimposed over a target 816 positioned behind and spaced apart from the light panel.

Figure 20:
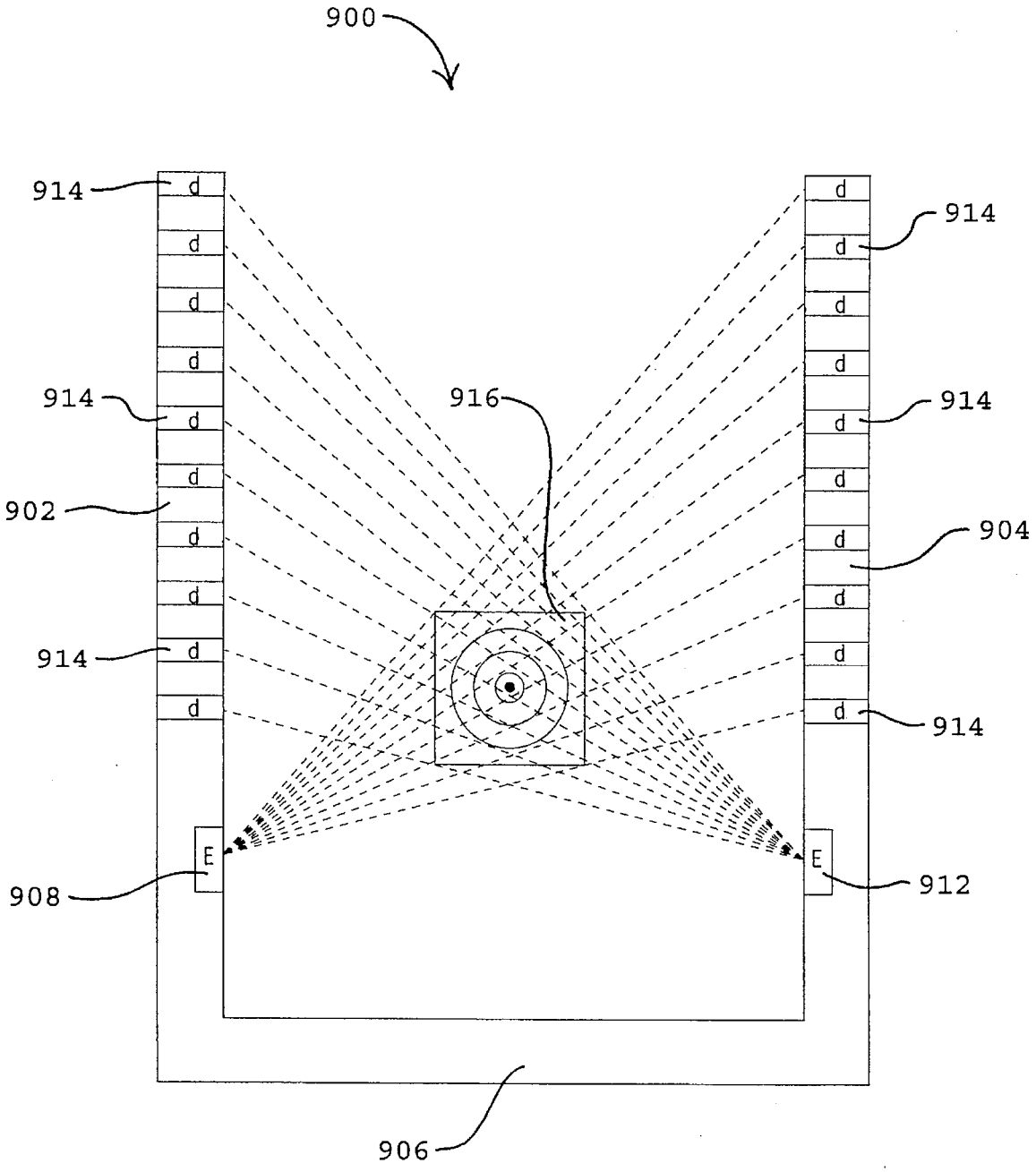
FIG. 20 is a front view of a light panel according to the present invention.

FIG. 20 shows a light panel 900 according to the present invention with three interconnected sides 902, 904 and 906. A first light emitter 908 is secured to or in the side 902 (and/or to the side 906) and a second emitter 912 is secured to or in the side 904 (and/or to the side 906). Each side 902, 904 has a plurality of light detectors 914 thereon or therein for sensing light from their corresponding emitter. The side 906 may be omitted. The light panel 900 is shown superimposed over a target 916 positioned behind and spaced apart from the light panel.

Light panels according to the present invention may have a frame with any of the shapes shown or any other suitable shape, including but not limited to circular, oval, parallelogram, pentagonal, sexagonal, heptagonal, octagonal etc. Alternatively it is within the scope of this invention to hold or support light emitter(s) and/or light detector(s) in a suitable configuration and/or disposition with any suitable supports or members, all included in the general term "frame".

Light panels according to the present invention which utilize light sources that emit fan-shaped planes of light beams towards a plurality of detectors located on opposite panel sides may have the detectors located in a variety of ways, including but not limited to: positioned equally spaced apart along a straight line opposite an emitter; located with varying detector-to-detector spacing between adjacent detectors along a straight line opposite an emitter such that equal angular spacing increments are provided between adjacent detectors; located equally spaced apart along a curved line or arc of constant radial distance from an emitter, an arrangement which also provides equal angular spacing increments between adjacent detectors. Electronic apparatus, in one aspect, is part of a light panel (e.g. associated with or on a frame of a panel like the panels 600, 700, 800, or 900) and receives and processes signal(s) generated by two spaced-apart light panels to calculate object velocity and then transmits a signal indicative of velocity to the computer. In any embodiment disclosed herein fiber optic cable(s) may be used to transmit light from locations on a light panel frame to another location and/or to one or more light sensors, e.g. but not limited to photosensor(s), remote from the panel(s).

SYSTEM USE

Figure 12A:
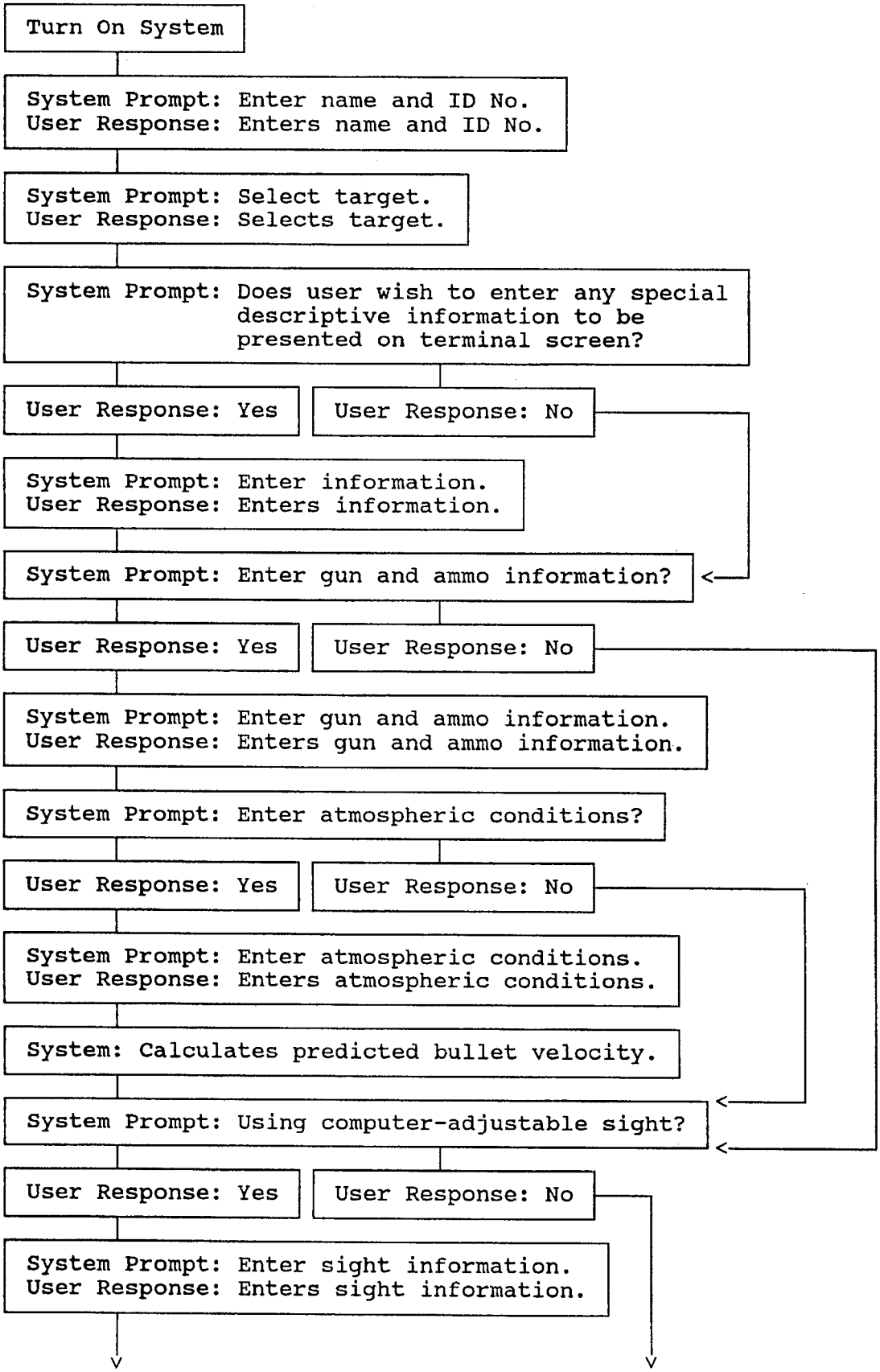
FIGS. 12*a* and 12*b* illustrate schematically an input method according to the present invention.
Figure 12B:
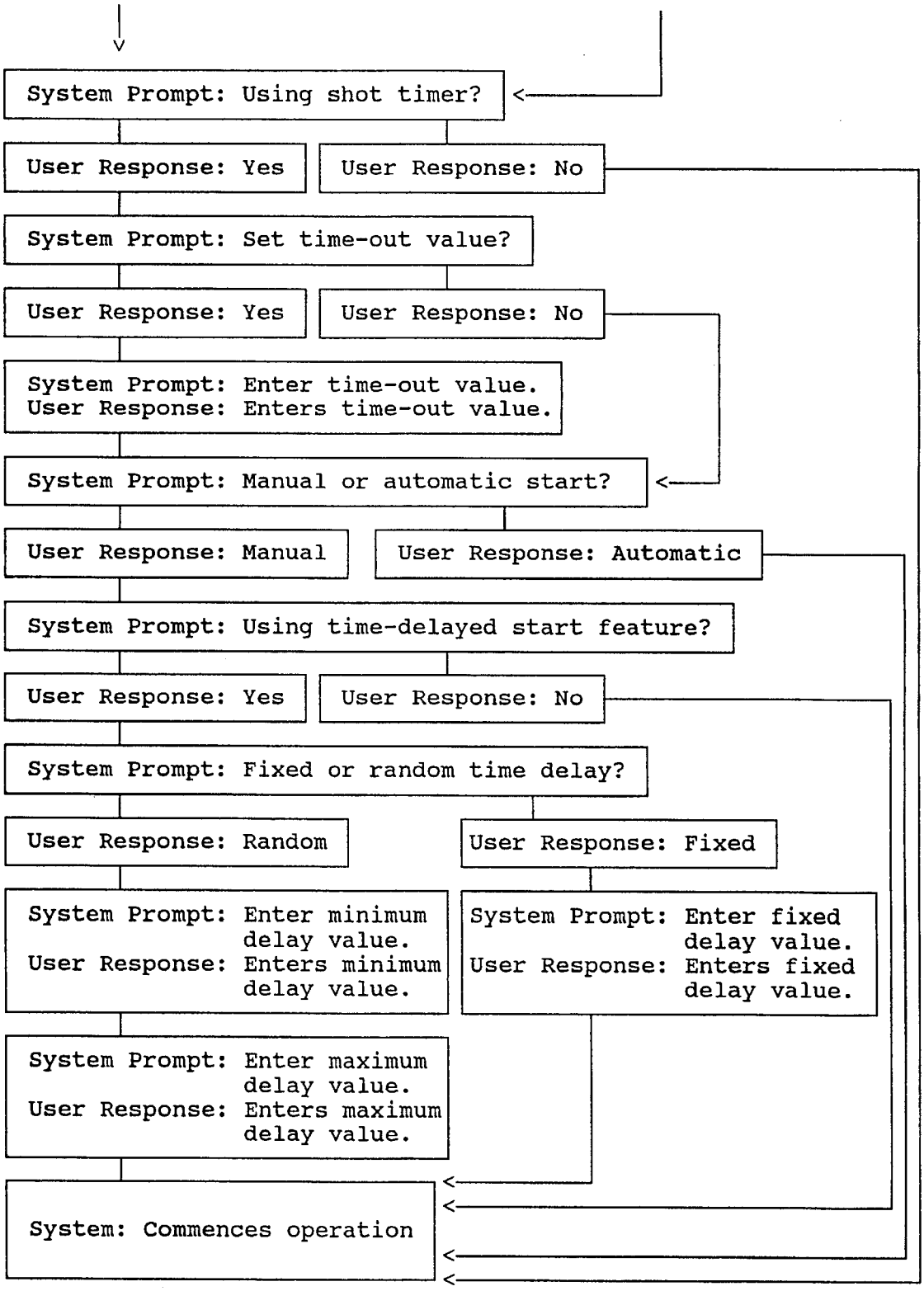

One target system according to this invention has a computer as previously described with internal devices and with software programs installed to accomplish the steps, methods and functions described herein. The computer, in one method, is turned "on", initializes and is ready to accept input from a new shooter (see FIGS. 12*a* and 12*b*). The new shooter (user) enters a name and identification number (ID No.) using a system computer keyboard. The system responds and asks the user to select a target from an on-screen menu or by entering a target number (e.g. four digits) for one of a plurality of available target images. The system then asks if the user wishes to enter any special descriptive information to be presented on the terminal monitor screen and preserved as part of the recorded results. If "yes", then the system responds with a terminal screen area into which the user enters information using the keyboard. If "no", then the system proceeds to a next prompt. The system asks if the user wishes to enter information about a firearm and ammunition in order for the computer to automatically calculate a predicted bullet velocity. If "yes", then the system responds with a series of prompts on the terminal screen whereby the user either makes choices from an on-screen menu, enters information using the keyboard or accepts system default values (e.g. see F5 softkey). If "no", then the system skips to a question regarding a computer-adjustable sighting device. The system asks if the user wishes to enter information regarding atmospheric conditions If "yes", then the system responds with a series of prompts on the terminal screen whereby the user either makes choices from an on-screen menu, enters information using the keyboard or accepts system default values (e.g. see F3 softkey). The system calculates predicted bullet velocity and stores it for display on the user's terminal screen. If "no", then the system skips to a question regarding the computer-adjustable sighting device. The system asks if the user is going to use a computer-adjustable sighting device. If "no", then the system skips to a question on shot timing If "yes", then the system responds with a series of prompts on the terminal screen whereby the user either makes choices from an on-screen menu, enters information using the keyboard or accepts system default values pertaining to the characteristics and features of the sighting device. The system asks if the user wishes to use the automatic shot timing system If "no", the system commences operation. If "yes", then the system proceeds through the steps shown in FIG. 12 related to the automatic shot timing system, beginning with "System Prompt: Set time-out value?" and the shooter responds appropriately at each prompt.

The system then commences operation and activates the target screen drive motor to give the user a fresh target screen; searches computer memory/storage media and finds the selected target and automatically transmits it to the video projector and computer monitor (target images may be either moving video targets or still image targets); activates the matrix light panel and chronograph panel; activates the downrange video projector which causes the selected target image to be projected onto the target screen (or activates the light(s) illuminating a preprinted target); presents the target image on the computer monitor along with shooter information, date, time, firearm/ammunition information, predicted bullet velocity, atmospheric conditions, distance to target, target number and tabular display form into which the shooter's results are entered as they occur; and issues a message of "Commence fire when ready" on the computer monitor and/or over the system's audio devices (user audio headset and/or loudspeaker); or, if the shot timer is being used in "manual" mode, the system prompts "Start timer when ready"; or, if using a computer-adjustable sighting device, the system prompts "connect computer cable and electrical power supply cable to sighting device and loosen all sight adjustment setscrews". In one embodiment a random start time is selectable so that the user is unaware of the precise moment when firing may be commenced. In one aspect the computer randomly chooses a start time within three to ten seconds of initiation. In one aspect the shot timing clock is automatically started when the first shot in a group is sensed by the system to have reached the target and/or stopped when the last shot in a group is sensed by the system to have reached the target. When preprinted target material is being used, the system computer activates (turns "on") and deactivates (turns "off") the light(s) illuminating the target area at the same times during the operating sequences that the video projector would normally be activated and deactivated.

Then the user starts the shot timer, if applicable (e.g. see F1 softkey). The user then commences firing shots at the target screen image.

The chronograph panel senses passage of a bullet projectile through it by sensing an interruption of one or more light beams projected between emitters and detectors, caused by the passing projectile. The signal generated by the interrupted light beam(s) of the chronograph panel is detected by the system's electronics and used to start the system's velocity measurement clock. The start time is transmitted to the computer where it is stored in memory. The matrix light panel and associated electronics sense passage of the projectile through it by sensing an interruption of one or more light beams projected between emitters and detectors, caused by the passing projectile, and calculates/transmits signals representing horizontal (X) and vertical (Y) coordinates of the interrupted beam(s) to the system computer. Also, the signal generated by the interrupted light beam(s) of the matrix light panel is detected by the system's electronics and used to stop the system's velocity measurement clock. The stop time is transmitted to the computer where it is stored in memory. Using the X-Y coordinate signals of the interrupted light beam(s) transmitted to it from the matrix light panel, the system computer: displays a graphic image of a "hole" onto the computer terminal screen representing the location where the bullet struck the target; calculates and displays the horizontal and vertical coordinates of the point of impact of the bullet relative to target center (if applicable to the selected target); for targets having different scoring values for hitting different areas of the target, determines and displays the scoring value corresponding to the X-Y coordinate of the bullet's point of impact; calculates the elapsed time of bullet passage between the chronograph and matrix light panels as measured by the velocity measurement clock; and with the distance between the two panels and projectile passage time, calculates and displays the measured velocity of the bullet (or, bullet velocity may be calculated by the light panels' associated electronics and transmitted to the system computer).

For multiple bullet projectiles, the system calculates and displays (as appropriate to the target being used)

- Shot Group Size
- Average Horizontal Coordinate (from target center)
- Average Vertical Coordinate (from target center)
- Average Score per Shot
- Total Score for All Shots
- Average Bullet Velocity
- Highest Bullet Velocity
- Lowest Bullet Velocity
- Extreme Spread (difference between highest and lowest velocity)
- Standard Deviation of Bullet Velocity If a computer-adjustable sighting device is being used, the system automatically calculates the necessary corrections after each shot based on the X-Y coordinate of the point of bullet impact at the target as measured by the matrix light panel. The user views the results of each shot on the system terminal screen prior to using the data to automatically adjust the sighting device. If acceptable, the user presses a key on the terminal keyboard and the computer automatically outputs control signals to the sighting device (and its associated servomotors) to cause the device to be adjusted. Users can accept or reject individual shots for use in automatically making adjustments. Users can also elect to have the system use the average horizontal and vertical coordinate values of several shots to make the automatic sight adjustments. Once the adjustments are completed, the system advises the user: "Sighting-in complete. Disconnect computer cable and electrical power supply cable from sighting device and tighten all sight adjustment setscrews."

If the automatic shot timing system is being used, the shooter's time clock is started either manually by depressing a softkey (e.g. F1) on the user's terminal keyboard, or automatically by the system's electronics/computer when the first projectile in a group is sensed by the matrix light panel to have reached the target screen. The shooter's time clock runs continuously until either the last shot in a group is sensed by the matrix light panel to have reached the target screen; the clock is manually stopped by depressing a softkey (e.g. F4) on the user's terminal keyboard; or the clock "times-out" and automatically stops after reaching a preset maximum shooter's time default value set by the system user during the set-up procedures. If the shooter's time clock does stop due to reaching its "time-out"/default value, the system displays "time expired" on the user's terminal screen and, if desired, announces it over the audio system. During system operation while using the automatic shot timing feature, the system calculates and displays for each shot: the time elapsed since the shooter's time clock was started; and the time elapsed between shots. The system also calculates and displays the average elapsed time between shots in a given group. When the last shot in a group is sensed by the matrix light panel to have reached the target screen or when the shooter's time clock reaches its time-out value, the system: deactivates the matrix light panel and chronograph panel; deactivates the downrange video projector (or the light(s) illuminating a preprinted target); issues a message of "cease fire" on the computer monitor and/or over the system's audio devices; and asks the user if it is desired to store the results in computer memory, print a hardcopy of the results, use the system again, or "quit".

Exemplary computer keyboard softkey functions for one system according to the present invention are as follows:

F1 "Start Timer"—starts shooter's time clock

F2 "Change Number of Shots"—allows user to input/change the number of shots that may be fired in a single group at a single target screen. (Default=10 shots)

F3 "Change Atmospheric Conditions"—allows user to input/change the atmospheric conditions used in calculating the predicted velocity of the bullet:

- Temperature (Default=59 degrees F.)
- Elevation (Default=sea level)
- Barometric Pressure (Default=29.53" Hg)
- Percent Humidity (Default=78%)
- Distance to Target (Default=25 ft)

F4 "Stop Timer"—stops shooter's time clock

F5 "Change Gun/Ammunition"—allows user to input/change the ammunition and firearm information used in calculating the predicted velocity of the bullet.

- Gun Information:
  - Type (handgun or rifle)
  - Style (automatic, revolver, bolt action)
  - Caliber (9 mm, .45, etc.)
  - Barrel Length (Default=handgun 4", rifle 20")
- Ammunition Information:
  - Manufacturer (If handloaded ammunition being used, or if computer does not have information from the manufacturer in its data files, the computer estimates BC based on bullet weight and type)

Bullet Weight (115 grains, etc.)

Bullet Type (JHP=jacketed hollow point, etc.)

Bullet Ballistic Coefficient (BC)—(If not known, computer calculates or looks up in data table based on bullet weight and type)

F6 "Change Target Selection"—allows user to input/change the target image being used. User is given an on-screen menu from which to select, or may enter a 4-digit target number.

F7 "New Shooter"—allows a new shooter to begin using the system. Responding to on-screen prompts at the user's terminal, the new shooter enters name and identification number and is then given the opportunity to accept the remaining system set-up parameters as-is or to reconfigure the system for new target selection, atmospheric conditions, ammunition and firearm.

F8 "New Target Screen"—allows user to activate the target screen drive motor at any time in order to replace the target screen.

F9 "Print Copy"—allows user to print a copy of the current monitor screen image at any time via the system printer.

F10 "Reset"—allows user to shut down system at any time and re-enter set-up sequence from the beginning; all set-up parameters are returned to their default values by the system computer.

F11 "Store/Retrieve Data Files"—allows user to store current results in the computer's memory base or to retrieve results stored previously.

F12 "System Manager"—allows the computer system manager to access maintenance and diagnostic programs used to ascertain that the system is functioning correctly; in one embodiment this is not a user-accessible softkey function and is password protected.

This invention discloses, in certain embodiments, (using systems as described with a computer and related apparatus, the computer with appropriate devices and software installed therein), a method of replacing a target or target screen downrange from a shooter which includes: transmitting a control signal initiated by a user from a computer to a downrange target screen drive mechanism (the control signal is a signal for instant action or for time delayed action, dependent on either an elapsed time period and/or on the occurrence of a number of shots as indicated by a shot sensor such as a matrix light panel or any other light panel described herein); the downrange drive mechanism receiving the signal from the computer with reception apparatus; and then the drive mechanism operating to remove one target or target screen and replace it with a new one. In one aspect of this method a target or target screen is automatically replaced if: 1. a new shooter begins using the system and goes through a system set-up; 2. if the same shooter opts to use the system again after shooting a prescribed number of shots or timing out; or 3. anytime a user presses the F8 "New Target Screen" softkey (e.g. if the target screen becomes damaged prior to finishing all shots).

This invention discloses, in certain embodiments, (using systems as described with a computer and related apparatus, the computer with appropriate devices and software installed therein), a method of producing a target image downrange from a shooter (system user) and/or on the system user's computer terminal monitor screen which includes: designating to the computer a selected target image (the computer having devices and apparatus to receive commands from a user and user accessible memory apparatus and storage location and memory address for the selected image); the computer having devices and apparatuses for accessing and transmitting the contents of the selected storage location containing the target image to a video projector located downrange and to a computer monitor positioned at the user's location; the video projector projecting the selected target image onto the target screen, preferably a replaceable target screen located downrange; and/or presenting the selected target image on the monitor screen at the user's location. The "computer's memory" includes any type of computer-accessible storage media device interconnected to the computer system.

In certain embodiments, this invention discloses (using systems as described with a computer and related apparatus, the computer with appropriate devices and software installed therein) a method for comparing a measured projectile velocity, kinetic energy, momentum, and power factor and a theoretical velocity, kinetic energy, momentum, and power factor, the method including: storing in a memory storage device in the computer published projectile ballistic information, ballistic equations, and data tables, the computer having installed therein appropriate devices and software programs to correct published ballistic information for standard conditions to conform to actual present shooting conditions for the various factors of gun barrel length, gun type, gun style, gun caliber, bullet weight, bullet type, bullet ballistic coefficient, temperature, elevation, barometric pressure, relative humidity, distance to target, and other parameters affecting bullet performance; calculating with the computer (with appropriate calculating device(s) and programming installed therein) predicted bullet velocity and/or kinetic energy, momentum, and power factor at the target location; displaying these factors on a computer monitor connected to the computer and controlled thereby; printing out, on a printer connected to and controlled by the computer, any or all of these factors; inputting into the computer input signals for clock start time and stop time from light panels which sense projectile passage (shot clock times); inputting into the computer a signal for the distance between the panels; storing the data represented by such signals in computer memory; calculating with the computer (with appropriate calculating device(s) and programming installed therein) actual velocity of the bullet, actual kinetic energy, actual momentum, and actual power factor and, if desired displaying such information on the monitor and/or printing out such information on the printer (or, in those embodiments in which the light panel itself has electronics therein or thereon or adjacent thereto and associated therewith for calculating actual bullet velocity, calculating bullet velocity with light panel electronics and transmitting the actual bullet velocity value itself to the system computer); and, if desired, calculating such actual or predicted factors and data for distances other than the actual distance of bullet travel from gun to target (e.g. muzzle conditions).

In certain embodiments, methods according to this invention (using systems as described with a computer and related apparatus, the computer with appropriate devices and software installed therein) to measure and track the location of a projectile's impact on a target include: projecting light beams across a light panel located in front of a target and detecting the beams with detectors either on the panel or remote therefrom; the light beam emitters and detectors arranged in a closely-spaced horizontal and vertical pattern or, alternately, the light beam emitters on different panel sides emitting fan-shaped planes of light beams in the direction of a plurality of closely-spaced light detectors located on panel sides opposite the emitters (like the panel 600), e.g. panel sides at right angles to each other with the light beams crossing through each other; sensing interruption of one or more of the beams by a bullet passing therethrough; the light panel and associated electronics generating signals representing the X-Y coordinates of the point of interruption; transmitting the signals to the computer; storing the signals as a point-of-impact location in the computer; displaying data and/or a visual representation of the point of impact on a monitor interconnected with and controlled by the computer; and/or printing out on paper such data and representation on a printer interconnected with and controlled by the computer; calculating and, optionally, displaying (and/or printing out) horizontal and vertical distances from a target center as well as a scoring value for such a point of impact.

In certain embodiments, methods according to this invention (using systems as described with a computer and related apparatus, the computer with appropriate devices and software installed therein) to display and keep track of scoring and results for a number of bullets include: generating, calculating and transmitting bullet velocity and point-of-impact-on-target locations as previously described; storing, processing, displaying (and/or printing out) such velocity and locations; calculating the factors and data regarding each shot as previously described and displaying it and/or printing it out; calculating average and cumulative results for multiple bullets (velocity, locations and scoring); and, optionally, displaying such results on a monitor connected to the computer (in tabular and/or graphic form) and/or printing out such results on a computer-controlled printer.

In certain embodiments, methods according to this invention (using systems as described with a computer and related apparatus, the computer with appropriate devices and software installed therein) to measure velocity of an object (e.g. but not limited to a bullet) include: generating and transmitting signals associated with light beam interruption in two spaced-apart light panels caused by object passage therethrough, the signals indicative of the precise moment in time of passage of the object through each light panel; the object passing through the two light panels on a common axis thereof; the computer processing the signals and calculating elapsed time between signals and thereby, coupled with the known distance between panels, calculating the average velocity of the object (or, in those embodiments in which the light panel itself has electronics therein or thereon or adjacent thereto and associated therewith for calculating actual object velocity, calculating object velocity with light panel electronics and transmitting the actual object velocity value itself to the system computer); and, if desired, displaying the velocity on a monitor interconnected with and controlled by the computer (and/or printing it out with a printer interconnected with and controlled by the computer).

In certain embodiments, methods according to this invention (using systems as described with a computer and related apparatus, the computer with appropriate devices and software installed therein) to automatically adjust a scope and/or sighting device (collectively "sights") on a gun include: generating and transmitting signals indicative of bullet point-of-impact-on-target location to the computer as previously described; the computer processing such signals and calculating with the computer distance from the actual point of impact to a desired point of impact (e.g. a bullseye image center); calculating with the computer coordinate corrections necessary to move the actual point of impact to the desired point of impact; producing with the computer adjustment signals for signalling the movement apparatus (e.g. a servomotor system) interconnected with the sights to move the sights so that the actual point of impact coincides with the desired point of impact. The sighting device movement apparatus receiving the adjustment signals from the computer (either automatically or upon direction from the user) and accomplishing the adjustment.

In certain embodiments, methods according to this invention (using systems as described with a computer and related apparatus, the computer with appropriate devices and software installed therein) to create a desired target image and to move it, if desired, with respect to a target surface downrange include: storing in the computer's memory a plurality of target images, including pictorial, color, and graphical images; presenting sequential target images on a downrange target surface with a video projector (and/or on an interconnected monitor) so that the image appears to move, the presentation generated and controlled by the computer; if desired, changing the color of all or part of an image; and, if desired, printing out such image(s) with an interconnected printer. The "computer's memory" includes any type of computer-accessible storage media device interconnected to the computer system.

In certain embodiments, methods according to this invention (using systems as described with a computer and related apparatus, the computer with appropriate devices and software installed therein) to print a hard copy of a shooter's results include: storing in computer memory as previously described signals indicative of a plurality of bullet impact locations and data of bullets shot by a shooter on a target; the shooter inputting a print command to the computer; the computer sending appropriate signals to an interconnected printer; and the printer, in response thereto, printing out a hard copy showing the shooter's results in tabulated and/or graphical form.

In certain embodiments, methods according to this invention (using systems as described with a computer and related apparatus, the computer with appropriate devices and software installed therein) to produce human voice audio information and/or commands for a shooter include: the computer generating signals for audio apparatus and transmitting them thereto which are indicative of particular stages in the shooting of one or more shots, e.g. "Ready," "Commence Firing," "Cease Firing"; the audio apparatus producing human voice (synthesized or recorded) announcements corresponding to each signal; if desired, the computer generating signals indicative of shot location, results, bullet parameters and/or scoring and the audio apparatus producing corresponding announcements; and, if desired, the computer generating signals indicative of elapsed and/or remaining time periods for a timed shot sequence and the audio apparatus producing corresponding announcements. Such methods may employ loudspeakers, personal head sets, or both. In one aspect such announcements are presented on the computer's monitor.

In certain embodiments, methods according to this invention (using systems as described with a computer and related apparatus, the computer with appropriate devices and software installed therein) to time shooting activity include: as previously described, generating signals indicative of shot clock time, location and score for each of a plurality of bullets impacting a target; storing such information in the computer memory; calculating with the computer elapsed time for each shot and total elapsed time for the plurality of shots combined; calculating the elapsed time between each shot; and, if desired, displaying such results on an interconnected monitor, announcing such results over an audio system, and/or printing out a hard copy thereof on an interconnected printer.

In certain embodiments, methods according to this invention (using systems as described with a computer and related apparatus, the computer with appropriate devices and software installed therein) to measure and track the location and/or size of an object passing through a light panel frame include: projecting light beams across a light panel positioned in the pathway of a moving object (or multiple objects) and detecting the beams with detectors either on the panel or remote therefrom; the light beam emitters and detectors arranged in a closely-spaced horizontal and vertical pattern or, alternately, the light beam emitters on different panel sides emitting fan-shaped planes of light beams in the direction of a plurality of closely-spaced light detectors located on panel sides opposite the emitters (like the panel 600) e.g. panel sides at right angles to each other with the light beams crossing each other; sensing interruption of one or more of the beams by an object(s) passing therethrough; the light panel and associated electronics generating signals representing the X-Y coordinates of the point(s) of interruption; transmitting the signals to the computer; storing the signals as object size and/or location coordinates in the computer; displaying data and/or a visual representation of the location coordinates and/or size on a monitor interconnected with and controlled by the computer; and/or printing out on paper such data and representation on a printer interconnected with and controlled by the computer; calculating and, optionally, displaying (and/or printing out) horizontal and vertical distances from a known point of reference (e.g. the center of the light panel frame) as well as a scoring value (if applicable) for such location coordinates and/or size.

A computer used in any embodiment of this invention, including but not limited to the preferred embodiments described above, has, in one aspect: storage apparatus with or in the computer for storing a plurality of target images to be displayed on the computer monitor or target screen, including images stored in any type of computer-accessible storage media device interconnected to the computer; and/or storage apparatus in the computer for storing the location of the point of bullet impact and the bullet velocity information transmitted to it from the first panel electronic apparatus; and/or calculating and storage apparatus in the computer for calculating and storing a variety of ballistic data regarding bullet performance and for analyzing and comparing such actual bullet ballistic data with known, predicted ballistic performance data for such a bullet; and a system according to the present invention with such a computer with any such apparatus may have movement apparatus positioned within the support member for moving the target.

In conclusion, therefore, it is seen that the present invention and the embodiments disclosed herein and those covered by the appended claims are well adapted to carry out the objectives and obtain the ends set forth. Certain changes can be made in the subject matter described, shown and claimed without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A light panel comprising a frame with a top, a bottom spaced apart from the top, a first side between the top and the bottom, and a second side spaced apart from the first side, the second side between the top and the bottom, the frame defining a frame space between its top, bottom, and two sides, at least one light emitter on the first side, the at least one light emitter for continuously emitting a fan-shaped light beam, across the frame through which and beyond which an object may pass, and at least one light detector on the second side of the frame for continuously detecting the fan-shaped light beam from the at least one light emitter.

2. The light panel of claim 1 wherein the at least one light emitter is two light emitters.

3. The light panel of claim 1 further comprising electronic sensing apparatus associated with the frame for detecting interruption of the light beams by an object passing through the frame space.

4. The light panel of claim 1 further comprising electronic calculating apparatus connected to the frame for calculating location coordinates of an object passing through the frame space.

5. The light panel of claim 1 further comprising electronic calculating apparatus connected to the frame for calculating size of an object passing through the frame space.

6. The light panel of claim 1 further comprising electronic calculating apparatus connected to the frame for calculating velocity of an object passing through the light panel frame space.

7. The light panel of claim 6 further comprising the electronic calculating apparatus also for transmitting data regarding the object.

8. The light panel of claim 1 wherein the object is a bullet fired from a gun.

9. The light panel of claim 8 wherein the at least one light emitter is a laser.

10. The light panel of claim 9 further comprising lens means adjacent the laser, the laser for providing a laser light beam to the lens means, and wherein the lens means is a line generating lens emitting a fan-shaped plane of light.

11. A light panel comprising a frame with a top, a bottom spaced apart from the top, a first side between the top and the bottom, and a second side spaced apart from the first side, the second side between the top and the bottom, the frame defining a frame space between its top, bottom, and two sides, at least one light emitter on the first side, and at least one light emitter on the bottom, the light emitters each for continuously emitting a fan-shaped light beam in a plane across the frame through which an object may pass, the light beams crossing each other in the frame space, at least one light detector on the second side of the frame for continuously detecting the fan-shaped light beam from the at least one light emitter on the first side, and at least one light detector on the top of the frame for continuously detecting the fan-shaped light beam from the at least one light emitter on the bottom of the frame.

12. The light panel of claim 11 further comprising electronic sensing apparatus the frame for detecting interruption of the light beams by an object passing through the frame space.

13. The light panel of claim 11 further comprising electronic calculating apparatus the frame for calculating size and location coordinates of an object passing through the frame space, and for calculating velocity of an object passing the light panel frame space and through, and for transmitting data regarding the velocity, size, and location coordinates.

14. The light panel of claim 11 wherein the at least one light emitter on the first side is a laser.

15. The light panel of claim 14 further comprising lens means adjacent the laser, the laser for providing a laser light beam to the lens means, and wherein the lens means is a line generating lens emitting a fan-shaped plane of light.

16. The light panel of claim 11 wherein the at least one light emitter on the bottom is a laser.

17. The light panel of claim 16 further comprising lens means adjacent the laser, the laser for providing a laser light beam to the lens means, and wherein the lens means is a line generating lens emitting a fan-shaped plane of light.

18. A light panel comprising a frame with a top and a bottom spaced apart from the top, the frame defining a frame space between its top and bottom, at least one light emitting fiber optic on the frame with lens means for continuously emitting a fan-shaped light beam across the frame through which an object may pass and having a first end on the frame and a second end spaced apart therefrom, at least one light receiving fiber optic on the frame disposed opposite from the at least one light emitting fiber optic with lens means and having a first end on the frame and a second end spaced apart therefrom, a light emitter adjacent the second end of the at least one light emitting fiber optic for continuously emitting light into the light emitting fiber optic, and a light detector adjacent the second end of the at least one light receiving fiber optic for continuously receiving light therefrom.

19. The light panel of claim 18 further comprising electronic sensing apparatus the frame for detecting interruption of the light beams by an object passing through the frame space.

20. The light panel of claim 18 further comprising electronic calculating apparatus the frame for calculating size and location coordinates of an object passing through the frame space, and for calculating velocity of an object passing through the light panel frame space, and for transmitting data regarding the velocity, size, and location coordinates.

21. The light panel of claim 18 wherein the object is a bullet fired from a gun.

22. The light panel of claim 18 wherein the light emitter adjacent the second end of the at least one light emitting fiber optic is a laser.

23. The light panel of claim 18 wherein the lens means is a line generating lens emitting a fan-shaped plane of light.

24. A targeting system for sensing a bullet fired from a gun at a target, the system comprising a computer, a light panel disposed adjacent the target and between the gun and the target, a bullet fired from the gun passing through at least one light beam of the light panel before contacting the target material, and the light panel producing a bullet signal in response to passage of the bullet therethrough, and the light panel comprising a frame with a top, a bottom spaced apart from the top, a first side between the top and the bottom, and a second side spaced apart from the first side, the second side between the top and the bottom, the frame defining a frame space between its top, bottom, and two sides, at least one light emitter on the first side, the at least one light emitter for continuously emitting a fan-shaped light beam across the frame through which and beyond which an object may pass, at least one light detector on the second side of the frame for continuously detecting the fan-shaped light beam from the at least one light emitter, and panel connection apparatus interconnecting the light panel and the computer, the bullet signal transmitted to the computer through the panel connection apparatus.

25. The targeting system of claim 24 wherein the at least one light emitter is two light emitters.

26. The targeting system of claim 24 further comprising electronic sensing apparatus connected to the frame for detecting interruption of light beams by an object passing through the frame space.

27. The targeting system of claim 24 further comprising electronic calculating apparatus connected to the frame for calculating location coordinates of an object passing through the frame space.

28. The targeting system of claim 24 further comprising electronic calculating apparatus connected to the frame for calculating size of an object passing through the frame space.

29. The targeting system of claim 24, the light panel further comprising electronic calculating apparatus the frame for calculating velocity of an object passing through the light panel frame.

30. The targeting system of claim 29 further comprising the electronic calculating apparatus also for transmitting data regarding velocity, size and location coordinates of the object.

31. A targeting system for sensing a bullet fired from a gun at a target, the system comprising a light panel disposed adjacent the target and between the gun and the target, a bullet fired from the gun passing through at least one light beam of the light panel before contacting the target, and the light panel producing a bullet signal in response to passage of the bullet therethrough, and the light panel comprising a frame with a top and a bottom spaced apart from the top, the frame defining a frame space between its top and bottom, at least one light emitting fiber optic on the frame with lens means for continuously emitting a fan-shaped light beam across the frame through which the bullet may pass and having a first end on the frame and a second end spaced apart therefrom, at least one light receiving fiber optic on the frame disposed opposite from the at least one light emitting fiber optic with lens means and having a first end on the frame and a second end spaced apart therefrom, a light emitter adjacent the second end of the at least one light emitting fiber optic for continuously emitting light into the light emitting fiber optic, and a light detector adjacent the second end of the at least one light receiving fiber optic for continuously receiving light therefrom.

32. The targeting system of claim 31 further comprising a computer, and panel connection apparatus interconnecting the light panel and the computer, the bullet signal transmitted to the computer through the panel connection apparatus.

33. The targeting system of claim 31 wherein the light emitter adjacent the second end of the at least one light emitting fiber optic is a laser.

34. The targeting system of claim 31 wherein the lens means is a line generating lens emitting a fan-shaped plane of light.

35. The targeting system of claim 31 wherein the at least one light emitter is two light emitters.

36. The targeting system of claim 31 further comprising electronic sensing apparatus connected to the frame for detecting interruption of the light beams by an object passing through the frame space.

37. The targeting system of claim 31 further comprising electronic calculating apparatus connected to the frame for calculating location coordinates of an object passing through the frame space.

38. The targeting system of claim 31 further comprising electronic calculating apparatus connected to the frame for calculating size of an object passing through the frame space.

39. The targeting system of claim 31 further comprising electronic calculating apparatus associated with the frame for calculating velocity of an object passing through the light panel frame space.

40. The targeting system of claim 31 further comprising the electronic calculating apparatus also for transmitting data regarding the object.

* * * * *